US012092120B2

(12) United States Patent
Metcalf et al.

(10) Patent No.: US 12,092,120 B2
(45) Date of Patent: Sep. 17, 2024

(54) ADJUSTABLE FAN ASSEMBLY

(71) Applicant: MILWAUKEE ELECTRIC TOOL CORPORATION, Brookfield, WI (US)

(72) Inventors: Christopher J. Metcalf, Wauwatosa, WI (US); Israel Amador, Marysville, WA (US); Nathan P. Liepert, Jackson, WI (US); Christopher S. Spaulding, Green Bay, WI (US); Alexander J. Goodman, Milwaukee, WI (US); Timothy J. Campbell, Brookfield, WI (US)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 0 days.

(21) Appl. No.: 17/693,870

(22) Filed: Mar. 14, 2022

(65) Prior Publication Data

US 2022/0290680 A1 Sep. 15, 2022

Related U.S. Application Data

(60) Provisional application No. 63/160,308, filed on Mar. 12, 2021.

(51) Int. Cl.

| | |
|---|---|
| ***F04D 25/08*** | (2006.01) |
| ***F04D 29/42*** | (2006.01) |
| ***F04D 29/60*** | (2006.01) |

(52) U.S. Cl.

CPC ..... *F04D 25/08* (2013.01); *F04D 29/4226* (2013.01); *F04D 29/601* (2013.01)

(58) Field of Classification Search

CPC ..... F04D 25/08; F04D 25/0673

See application file for complete search history.

(56) References Cited

U.S. PATENT DOCUMENTS 1,861,608 A * 6/1932 Persons ..... F04D 25/0606 415/125

2,345,516 A * 3/1944 Weber ..... F04D 29/703 D23/370

(Continued)

FOREIGN PATENT DOCUMENTS

CN 107061327 A 8/2017

CN 208503059 U 2/2019

(Continued)

OTHER PUBLICATIONS

International Search Report and Written Opinion for Application No. PCT/US2022/020146 dated Jun. 23, 2022 (10 pages).

(Continued)

*Primary Examiner* — Thomas Fink

(74) *Attorney, Agent, or Firm* — Michael Best & Friedrich LLP

(57) ABSTRACT

A fan assembly includes a fan housing including a shroud that at least partially defines an airflow chamber, a battery receptacle supported on the shroud, a first grille positioned adjacent a first end of the airflow chamber, a fan supported within the airflow chamber and rotatably coupled to one of the first grille or the shroud, and a motor supported on the other of the first grille or the shroud. The motor is operable to drive rotation of the fan and thereby generate airflow through the airflow chamber. The fan assembly further includes a base coupled to the fan housing. The base is operable to support the fan housing in multiple configurations to direct the airflow in multiple directions.

9 Claims, 27 Drawing Sheets

(56) References Cited

U.S. PATENT DOCUMENTS

| | | | | | |
|---|---|---|---|---|---|
| 2,728,519 | A * | 12/1955 | McLarty | F04D 29/703 | 416/247 R |
| 4,022,548 | A * | 5/1977 | McLarty | F04D 29/703 | 415/121.2 |
| 4,142,844 | A * | 3/1979 | Brattstrom | F04D 25/12 | 416/243 |
| 4,657,483 | A * | 4/1987 | Bede | F04D 29/545 | 74/609 |
| D306,903 | S | 3/1990 | Shin-Chin | | |
| 5,304,040 | A | 4/1994 | Wang | | |
| 5,391,056 | A | 2/1995 | Wang | | |
| D426,296 | S | 6/2000 | Blateri | | |
| 6,126,415 | A * | 10/2000 | Lasko | F24F 7/007 | 416/246 |
| D444,552 | S | 7/2001 | Wang | | |
| D480,466 | S | 10/2003 | Bucher et al. | | |
| D482,438 | S | 11/2003 | Barker et al. | | |
| D483,468 | S | 12/2003 | Wong | | |
| D531,718 | S | 11/2006 | Bucher et al. | | |
| D571,448 | S | 6/2008 | Bucher et al. | | |
| 7,850,513 | B1 * | 12/2010 | Parker | F24F 7/025 | D13/102 |
| D674,888 | S * | 1/2013 | Kawase | D23/370 | |
| D686,309 | S * | 7/2013 | Kokawa | D23/382 | |
| 8,821,129 | B2 | 9/2014 | Heli et al. | | |
| D845,465 | S | 4/2019 | Cui | | |
| D945,592 | S | 3/2022 | Mo | | |
| D952,125 | S | 5/2022 | He et al. | | |
| D963,149 | S | 9/2022 | He et al. | | |
| D967,391 | S | 10/2022 | Lin | | |
| 2012/0269663 | A1 * | 10/2012 | Kamiya | F04D 25/0673 | 417/411 |
| 2015/0282356 | A1 * | 10/2015 | Takahashi | F04D 25/0673 | 361/679.01 |
| 2020/0208654 | A1 * | 7/2020 | Weinmeister | F04D 25/084 | |
| 2021/0364175 | A1 | 11/2021 | Naehu | | |
| 2022/0080437 | A1 * | 3/2022 | Zhong | B05B 1/3006 | |
| 2023/0118363 | A1 | 4/2023 | Zhong et al. | | |

FOREIGN PATENT DOCUMENTS

| | | | |
|---|---|---|---|
| CN | 208763951 | U | 4/2019 |
| CN | 211737494 | U | 10/2020 |
| CN | 211778095 | U | 10/2020 |
| JP | 2013213449 | A | 10/2013 |
| JP | 3224744 | U | 1/2020 |
| KR | 100932736 | B1 | 12/2009 |

OTHER PUBLICATIONS

XPower Manufacturing, "Industrial Circulation Fan: 18" Dia, 3,600 CFM," <https://www.mscdirect.com/product/details/98943004> Year: 2023 (3 pages).

* cited by examiner

ADJUSTABLE FAN ASSEMBLY

CROSS-REFERENCE TO RELATED APPLICATIONS

This application claims priority to U.S. Provisional Patent Application No. 63/160,308, filed Mar. 12, 2021, the entire contents of which are incorporated by reference herein.

FIELD

The application relates to adjustable fan assemblies, and more specifically, to battery powered fans having various adjustable aspects.

SUMMARY

In one embodiment, the invention provides a fan assembly including a fan housing including a shroud that at least partially defines an airflow chamber; a battery receptacle positioned on the shroud, the battery receptacle configured to receive a removable battery pack to provide power to the fan assembly; a first grille coupled to a first side of the shroud, the first grille positioned adjacent an end of the airflow chamber; a fan supported within the airflow chamber, the fan being rotatably coupled to a portion of the shroud; a motor supported by the first grille, the motor operable to drive rotation of the fan and thereby generate airflow through the airflow chamber; and a base coupled to the fan housing, the base operable to support the fan housing in multiple configurations to direct the airflow in multiple directions.

In another embodiment, the invention provides a fan assembly including a fan housing including a shroud that at least partially defines an airflow chamber; a battery receptacle positioned on the shroud, the battery receptacle configured to receive a removable battery pack to provide power to the fan assembly; a first grille coupled to a first side of the shroud, the first grille positioned adjacent an end of the airflow chamber; a fan supported within the airflow chamber, the fan being rotatably coupled to a portion of the first grille; a motor supported by the shroud, the motor operable to drive rotation of the fan and thereby generate airflow through the airflow chamber; and a base coupled to the fan housing, the base operable to support the fan housing in multiple configurations to direct the airflow in multiple directions.

In yet another embodiment, the invention provides a fan assembly including a fan housing including a shroud that at least partially defines an airflow chamber; a battery receptacle supported on the shroud, the battery receptacle configured to receive a removable battery pack to provide power to the fan assembly; a first grille positioned adjacent a first end of the airflow chamber; a fan supported within the airflow chamber and rotatably coupled to one of the first grille or the shroud; a motor supported on the other of the first grille or the shroud, the motor operable to drive rotation of the fan and thereby generate airflow through the airflow chamber; and a base coupled to the fan housing, the base operable to support the fan housing in multiple configurations to direct the airflow in multiple directions.

Other aspects of the disclosure will become apparent by consideration of the detailed description and accompanying drawings.

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Unless specified or limited otherwise, the terms "mounted," "connected," "supported," and "coupled" and variations thereof are used broadly and encompass both direct and indirect mountings, connections, supports, and couplings.

DETAILED DESCRIPTION

Figure 2:
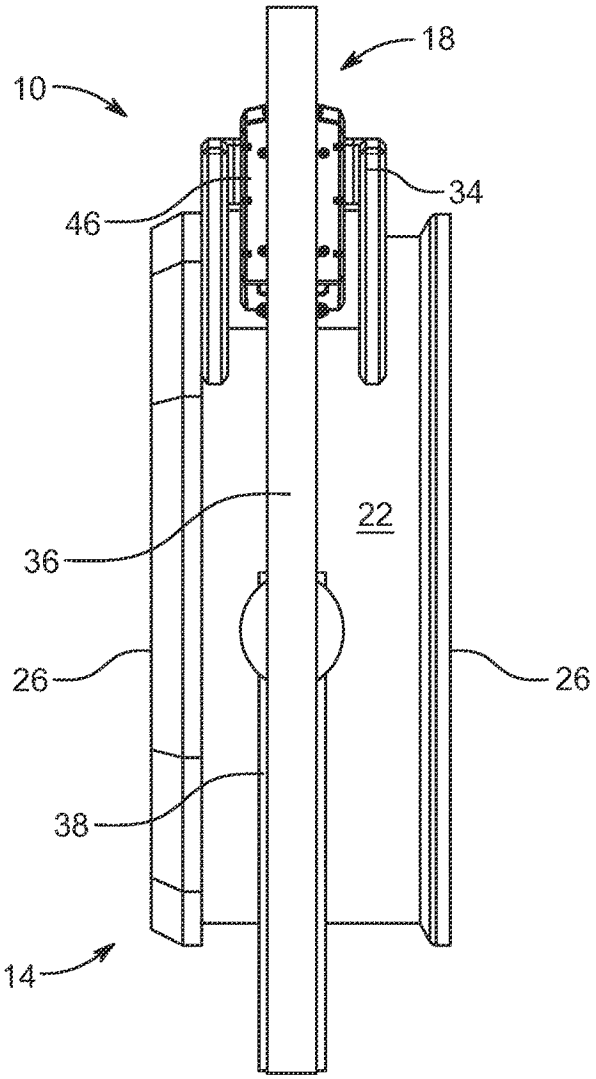
FIG. 2 is side perspective view of the fan assembly of FIG. 1 in a collapsed configuration.
Figure 1:
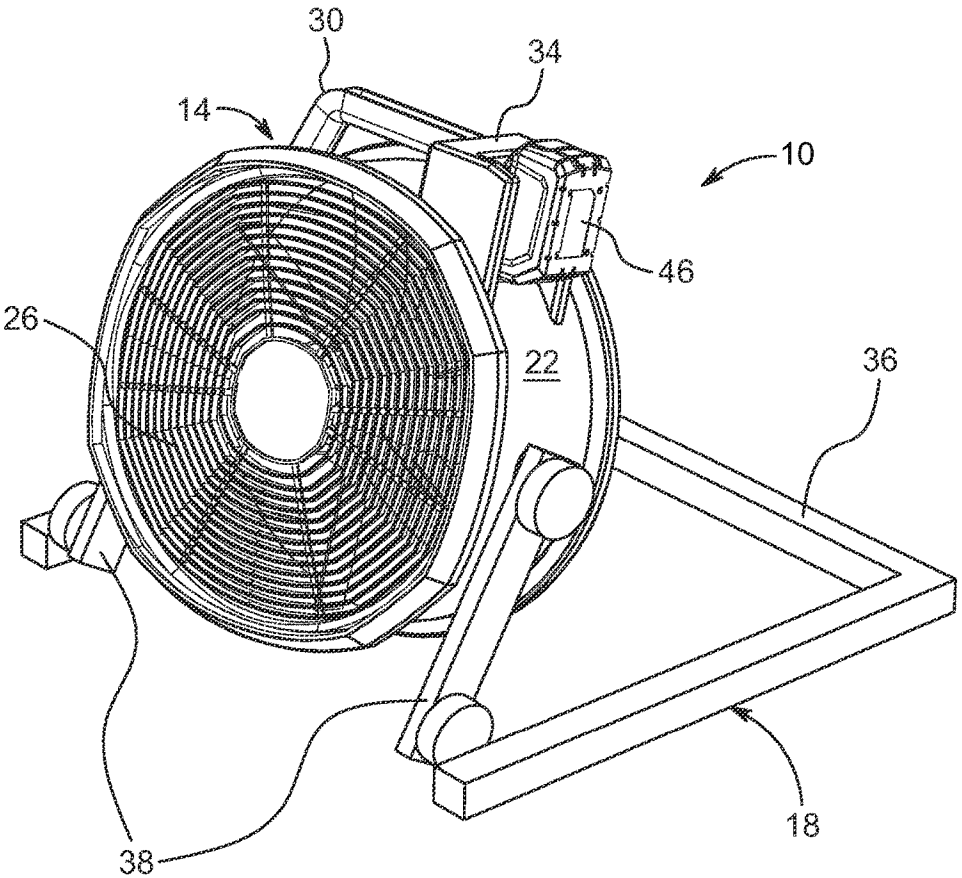
FIG. 1 is a perspective view of a fan assembly, including a housing and an adjustable base, according to one embodiment.

FIGS. 1 and 2 illustrate a cooling apparatus, such as a fan assembly 10, according to one embodiment. The fan assembly 10 includes a housing 14 and a base 18 that is configured to support the housing 14 in multiple predetermined configurations (e.g., orientation, height, direction, etc.). The housing 14 may include a shroud 22, one or more grilles 26, a handle 30, and a battery receptacle 34. In the illustrated embodiment, the battery receptacle 34 is supported on a circumferential wall of the housing 14, and more particularly, on the shroud 22. The base 18 includes a support bar 36 and linkages 38, that are moveably (e.g., rotatably) attached to the support bar 36 and to the housing 14 to retain the housing 14 in a desired configuration.

Figure 3:
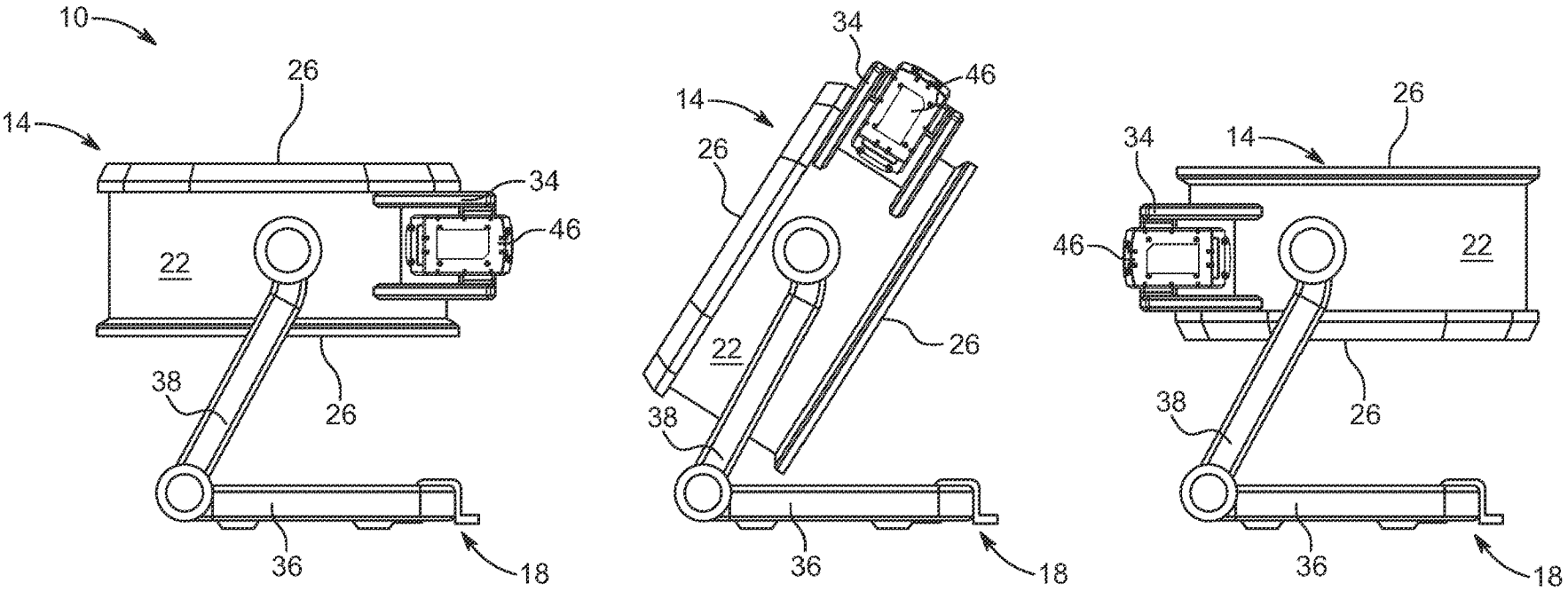
FIG. 3 is a side view of the fan assembly FIG. 1, showing the housing in three possible orientations with respect to the base.

As shown in FIGS. 1-3, the fan assembly 10 is positionable in various orientations including, for example, an angled upright or expanded position (FIGS. 1 and 3), a generally flat or collapsed position (FIG. 2), an upward-facing position (FIG. 3), a downward-facing position (FIG. 3), and other positions and intermediate positions not specifically illustrated (e.g., a partially expanded position, a partially collapsed position, etc.).

In the illustrated embodiment, the support bar 36 forms a generally square perimeter which provides a support surface for the fan assembly 10 while in the example expanded position. The perimeter of the support bar 36, as shown in FIG. 2, may extend beyond an overall dimension of the housing 14 such that the housing 14 may be received within the perimeter while in the example collapsed position. While in the example collapsed position, an overall profile of the fan assembly 10 may be reduced to allow for easier storage and/or transportation of the fan assembly 10. In some embodiments, the perimeter of the support bar 36 is between about 18 to 30 inches by about 18 to 30 inches, and more particularly, is about 27 inches by 28 inches. In addition, in the collapsed configuration (FIG. 2), the fan assembly 10 has a height of about 7 to 8 inches.

In the illustrated embodiment, the linkages 38 are rotatably supported by the support bar 36 at one end and rotatably support the housing 14 at an opposite end. In the illustrated embodiment, the housing 14 is rotatable relative to the linkages 38, which are rotatable relative to the support bar 36, such that the housing 14 is rotatable through multiple degrees of freedom. Some friction exists within the rotatable connections made between the linkages 38 and the housing 14 and the support bar 36 to the linkages 38 such that some amount of friction force must be overcome for rotation to occur. Such connections allow the fan assembly 10 to be set and held in a desired position. In some embodiments, the housing 14 may be rigidly supported by the linkages 38. In other embodiments, the connections between the housing 14 and the linkages 38, and between the linkages 38 and the support bar 36, could be another type of connection such as a sliding connection, a magnetic coupling, a telescoping connection, or the like.

With continued reference to FIG. 1, the base 18 may selectively support the housing 14 on a substantially horizontal surface (e.g., floor surface, tabletop, work bench, etc.). In other embodiments, the base 18 includes a mounting assembly configured to mount the fan assembly 10 to a vertical surface, such as a wall surface. In still other embodiments, the base 18 includes a clamping assembly configured to mount the fan assembly 10 to an edge surface, such as a plank, stud, desk edge, or the like.

Figure 5:
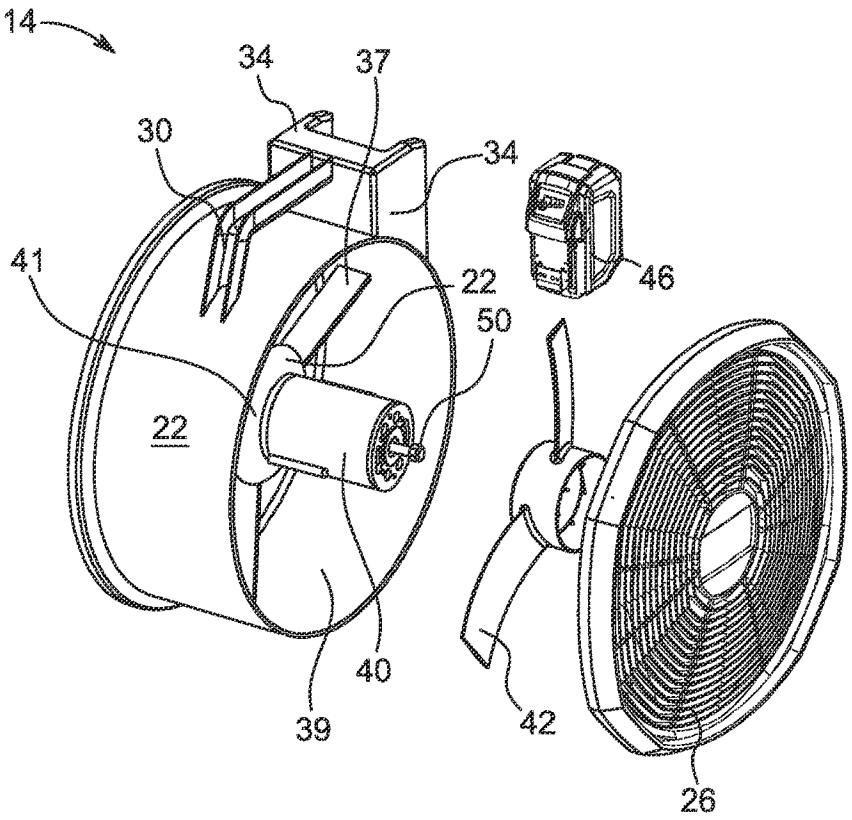
FIG. 5 is a partially exploded view of the fan housing of FIG. 1, illustrating an alternative position of the motor, according to another example construction.
Figure 4:
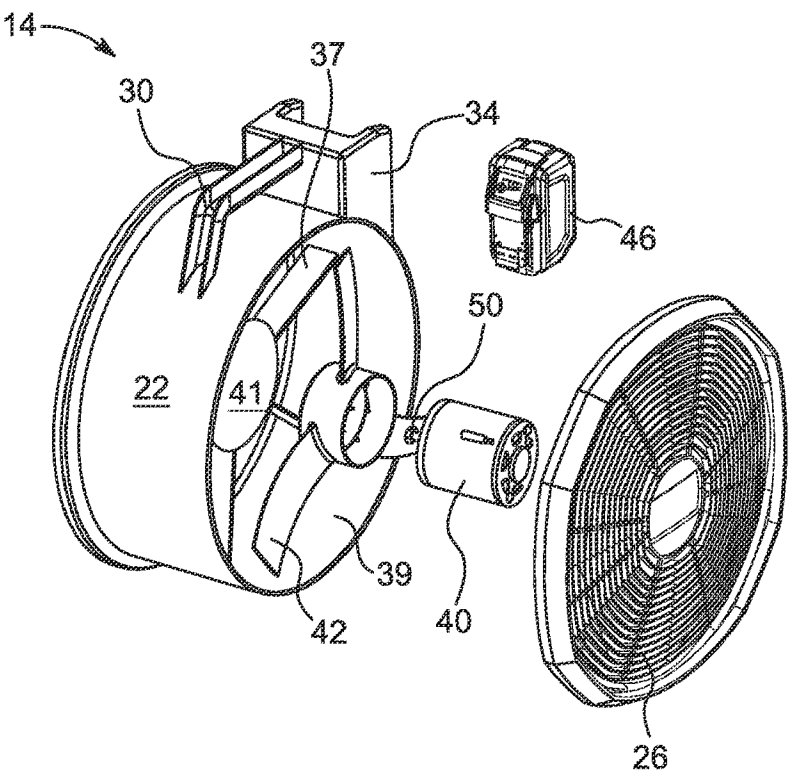
FIG. 4 is a partially exploded view of the fan housing of FIG. 1, illustrating a position of a motor, according to one example construction.

Referring now to FIGS. 4 and 5, the housing 14 further supports a motor 40 and one or more blades 42 rotatable by the motor 40 to generate an airflow through an airflow chamber formed by the shroud 22. In the illustrated embodiment, vanes 37 extend inwardly from an outer wall 39 of the shroud 22 to a mount 41. The mount 41 may support the blades 42 (FIG. 4) or the motor 40 (FIG. 5), in some example constructions. The shroud 22 may support the grilles 26 at terminating ends, at a single end, or at a position between at terminating ends. In other embodiments, the blades may be arranged to generate an airflow across an airfoil (e.g., "bladeless" fan). In such embodiments, grilles may be omitted. The motor 40 may receive power from a battery pack 46 selectively received by the battery receptacle 34 to power rotation of the blades 42. In other embodiments, the motor 40 may receive power from another AC or DC source such as a wall outlet, a generator, or the like.

The battery pack 46 may be a power tool battery pack generally used to power a power tool, such as an electric drill, an electric saw, and the like (e.g., an 18 volt rechargeable battery pack, or an M18 REDLITHIUM battery pack sold by Milwaukee Electric Tool Corporation). The battery pack 46 may include lithium ion (Li-ion) cells. In alternate embodiments, the battery packs may be of a different chemistry (e.g., nickel-cadmium (NiCa or NiCad), nickel-hydride, and the like). In the illustrated embodiments, the battery pack 46 is an 18 volt battery pack. In alternate embodiments, the capacity of the battery pack 46 may vary (e.g., the battery pack 46 may be a 4 volt battery pack, a 28 volt battery pack, a 40 volt battery pack, or battery pack of any other voltage).

FIG. 4 illustrates one example construction of the housing 14 in which the motor 40 is supported by the grille 26 at one end with a rotating spindle 50 of the motor 40 extending rearwardly into the blades 42. In the example construction shown in FIG. 4, wiring between (e.g., electrically communicating) the motor 40 and the battery pack 46 may be routed through a portion of the shroud 22 and/or a portion of the grille 26 to deliver power to the motor 40. Stated another way, FIG. 4 illustrates one example construction of the housing 14 in which the motor 40 is supported forwardly of the blades 42. In some embodiments, wiring electrically communicating the battery receptacle 34 and the motor 40 is routed through at least one of the vanes 37. In the illustrated embodiment, a rotational axis of the blades 42 and a rotational axis of the rotating spindle 50 are centrally aligned relative to one another within the airflow chamber.

FIG. 5 illustrates another example construction of the housing 14 in which the motor 40 is supported by the shroud 22 at one end with the rotating spindle 50 of the motor 40 extending forwardly into the blades 42. In the example construction shown in FIG. 5, wiring between the motor 40 and the battery pack 46 may be routed through a portion of the shroud 22 to deliver power to the motor 40. Stated another way, FIG. 5 illustrates one example construction of the housing 14 in which the motor 40 is supported rearwardly of the blades 42. Regardless of construction, the motor 40 may be operated at multiple predetermined speeds in order to provide multiple modes of operation of the fan assembly (e.g., high, medium, low, etc.).

Figure 6C:
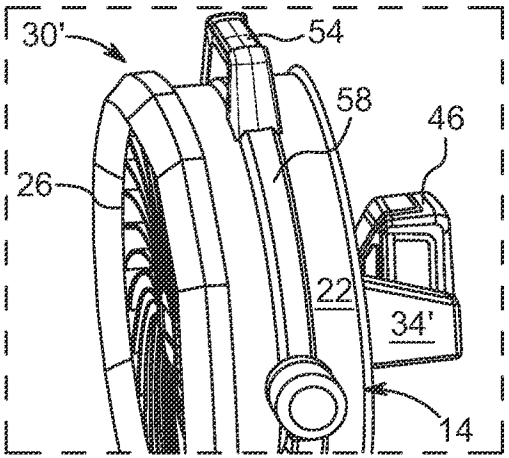
FIG. 6C is another magnified view of the fan housing of FIG. 6A, showing a possible position of a battery, according to one example construction.
Figure 6B:
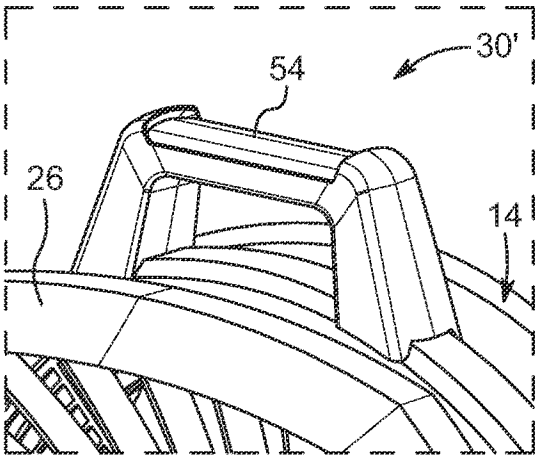
FIG. 6B is another magnified view of the handle of FIG. 6A in an operated position.
Figure 6A:
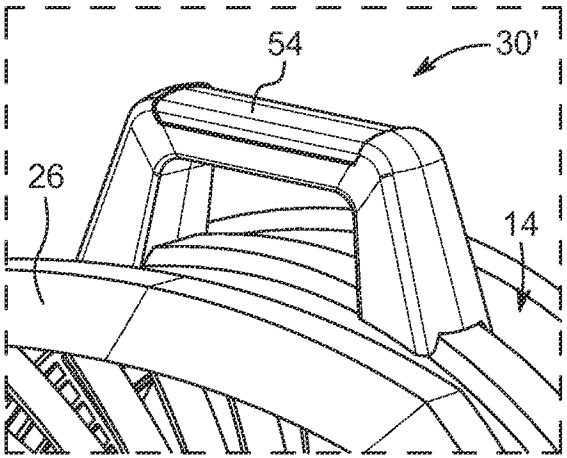
FIG. 6A is a magnified view of a handle of a fan housing, according to another embodiment, in an unoperated position.

FIGS. 6A-6C illustrate an example construction of the housing 14 which includes an alternate handle 30' and alternate battery receptacle 34' in another example position. The alternate handle 30' may include a button 54 configured to be moved (e.g., pressed, squeezed, or the like) by a hand of a user to selectively control the rotation of the housing 14 relative the base 18. The button 54 may be moved, relative to the alternate handle 30', from an unoperated position (FIG. 6A) in which the housing 14 is not moveable, to an operated position (FIG. 6B) in which the button 54 is depressed and the housing 14 is moveable. A biasing member may bias the button toward the unoperated position.

While in the unoperated position, an internal mechanism connected to the button 54 inhibits (e.g., blocks, brakes, etc.) the housing 14 from rotating relative the base 18. While in the operated position, the internal mechanism may be retracted, retreated, removed, or the like such that the housing 14 is permitted to be rotated relative the base 18. The internal mechanism may be concealed in a channel 58 formed on an exterior circumferential wall of the housing 14. In some embodiments, the internal mechanism is integrally formed in the housing 14. The internal mechanism may further extend through the linkages 38 to simultaneously prohibit/permit relative movement between the housing 14 and linkages 38, and between the linkages 38 and support bar 36.

With brief reference to FIG. 6C, the alternate battery receptacle 34' may be positioned on a rear portion or face of the shroud 22. In some embodiments, wiring from the alternate battery receptacle 34' to the motor may be routed through the channel 58. In other embodiments, the motor is supported adjacent the alternate battery receptacle 34' such that minimal to no wiring needs to be routed through or on a part of the housing 14. In still other embodiments, the battery receptacle(s) may be positioned on the base.

Figure 8:
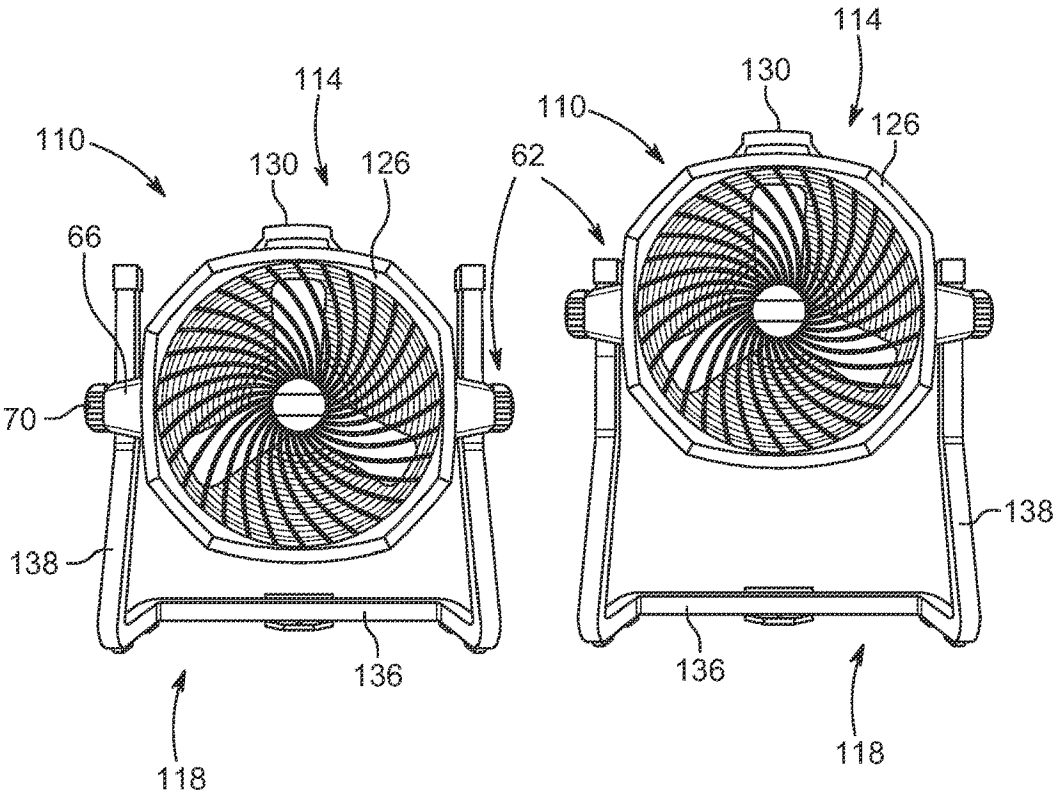
FIG. 8 is a front view of the fan assembly of FIG. 7, showing the housing at two possible heights with respect to the base.
Figure 7:
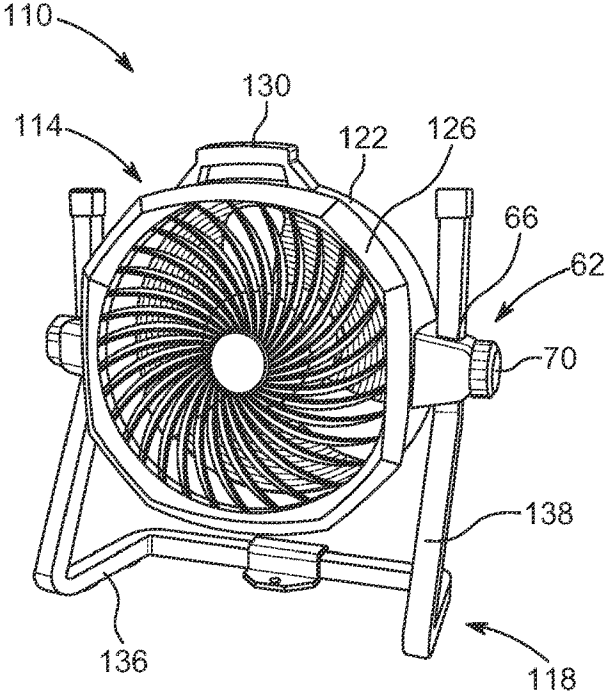
FIG. 7 is a perspective view of a fan assembly, including a housing and a base, according to another embodiment.

FIGS. 7 and 8 illustrate a fan assembly 110 according to another embodiment. The fan assembly 110 of FIGS. 7 and 8 is similar to the fan assembly 10 described above with reference to FIGS. 1-6, and similar features are identified with similar reference numbers, plus "100." Some differences between the fan assembly 10 and the fan assembly 110 are described.

Referring to FIG. 7, the fan assembly 110 includes a housing 114 and a base 118. The housing 114 includes a shroud 122, grilles 126, a handle 130, and a battery receptacle. The base 118 may be formed as a single member having opposing arms 138 configured to support the housing 114 at various heights.

The fan assembly 110 further includes a height adjusting mechanism 62 configured to retain the housing 114 in a desired height relative to the base 118. The height adjusting mechanism 62 includes an aperture 66 formed on either side of the housing 114, and a respective knob 70 selectively secured thereon. In the illustrated embodiment, the knob 70 is formed with a fastener (e.g., screw, magnet, pin, etc.) that is selectively received in the height adjusting mechanism 62. The aperture 66 on each side of the housing 114 is configured to slidably receive one of the opposing arms 138 of the base 118, and the fasteners of the respective knobs 70 are operable to extend through the height adjusting mechanism 62 on either side to bear against the opposing arm 138 received therein. As shown in FIG. 8, the height adjusting mechanism 62 may be utilized to retain the housing 114 at different heights relative the base 118.

Figure 10:
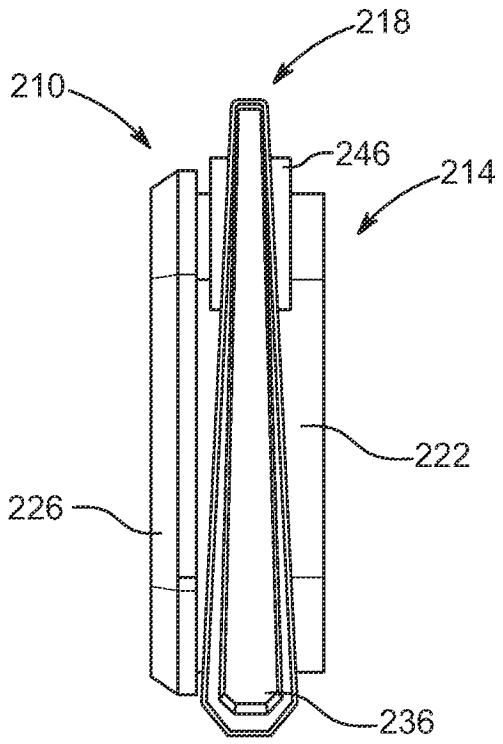
FIG. 10 is side view of the fan assembly of FIG. 9 in a collapsed configuration.
Figure 9:
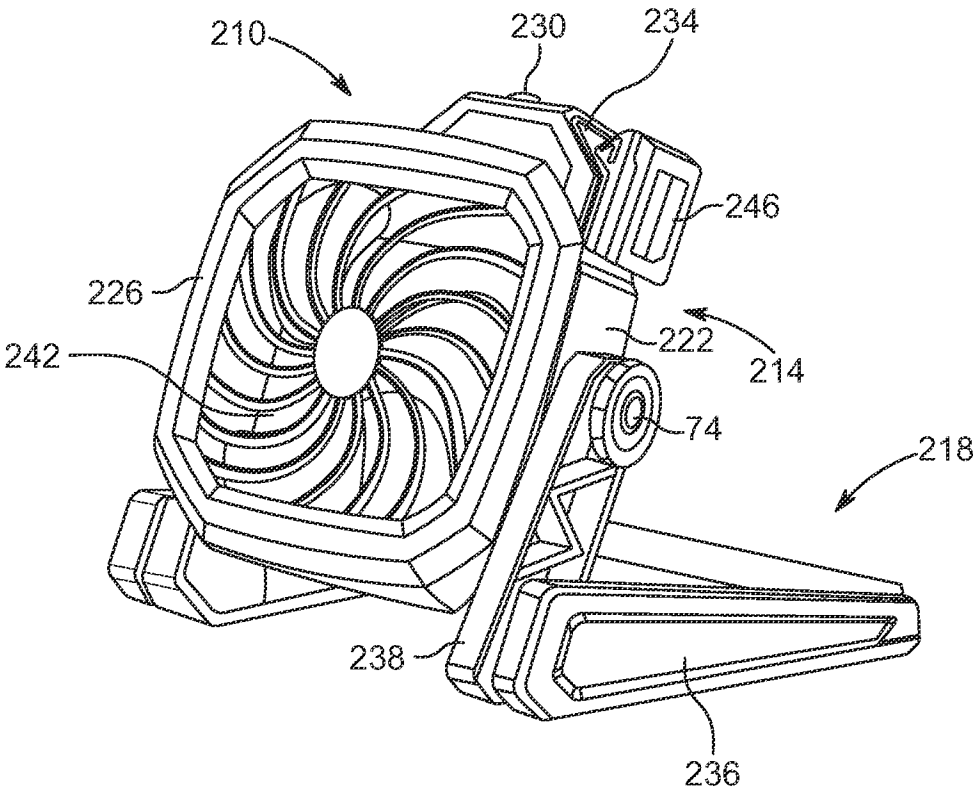
FIG. 9 is a perspective view of a fan assembly, including a housing and a base, according to another embodiment.

FIGS. 9 and 10 illustrate a fan assembly 210 according to another embodiment. The fan assembly 210 of FIGS. 9 and 10 is similar to the fan assembly 10 described above with reference to FIGS. 1-6, and similar features are identified with similar reference numbers, plus "200." Some differences between the fan assembly 10 and the fan assembly 210 are described.

As shown in FIGS. 9 and 10, the fan assembly 210 is positionable in various orientations including, for example, an angled upright or expanded position (FIG. 9), a generally flat or collapsed position (FIG. 10), or another position not illustrated (e.g., a partially expanded position, a partially collapsed position, etc.).

Referring to FIG. 9, the fan assembly 210 includes a housing 214 and a base 218. The housing 214 is generally polygonal and includes a shroud 222, a grille 226, and a battery receptacle 234. The base 218 may include a support bar 236 forming a generally square perimeter which provides a support surface for the fan assembly 210 while in the example expanded position. The perimeter of the support bar 236, as shown in FIG. 10, may extend beyond an overall dimension of the housing 214 such that the housing 214 may be received within the perimeter while in the example collapsed position. The base 218 may further include linkages 238 rotatably supported by the support bar 236 at one end and that rotatably support the housing 214 at an opposite end.

Similar to the embodiment of FIG. 1, the housing 214 is rotatable relative to the linkages 238, which are rotatable relative to the support bar 236, such that the housing 214 is rotatable through multiple degrees of freedom. One example difference from the embodiment of FIG. 1 is that the rotatable connections made between the linkages 238 and the housing 214 and/or the support bar 236 to the linkages 238 may additionally include a tightening knob 74, similar to the knob 70 described with respect to FIGS. 7 and 8. The tightening knob 74 allows a user to selectively adjust a tightness/resistance present in the example rotatable connections. For example, the housing 214 and linkages 238 are moveable relative one another when the tightening knob 74 is loosened and inhibited from relative movement when the tightening knob 74 is tightened. In other embodiments, the knob may be a sliding lug, tooth, or the like to prevent relative movement between the housing and linkages.

Figure 12:
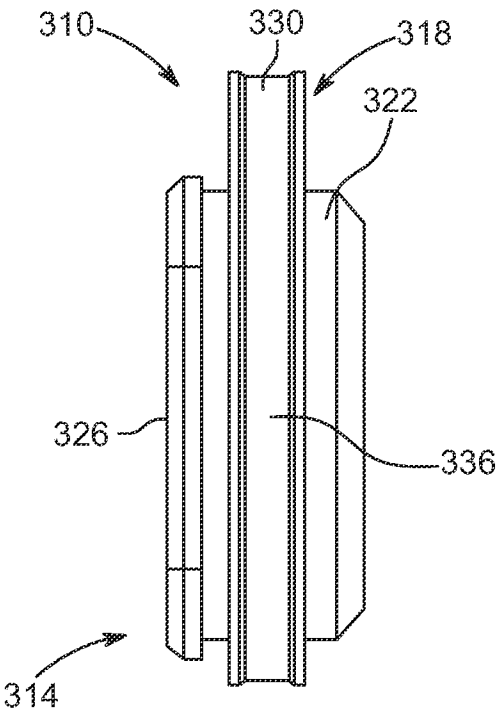
FIG. 12 is side view of the fan assembly of FIG. 11 in a collapsed configuration.
Figure 11:
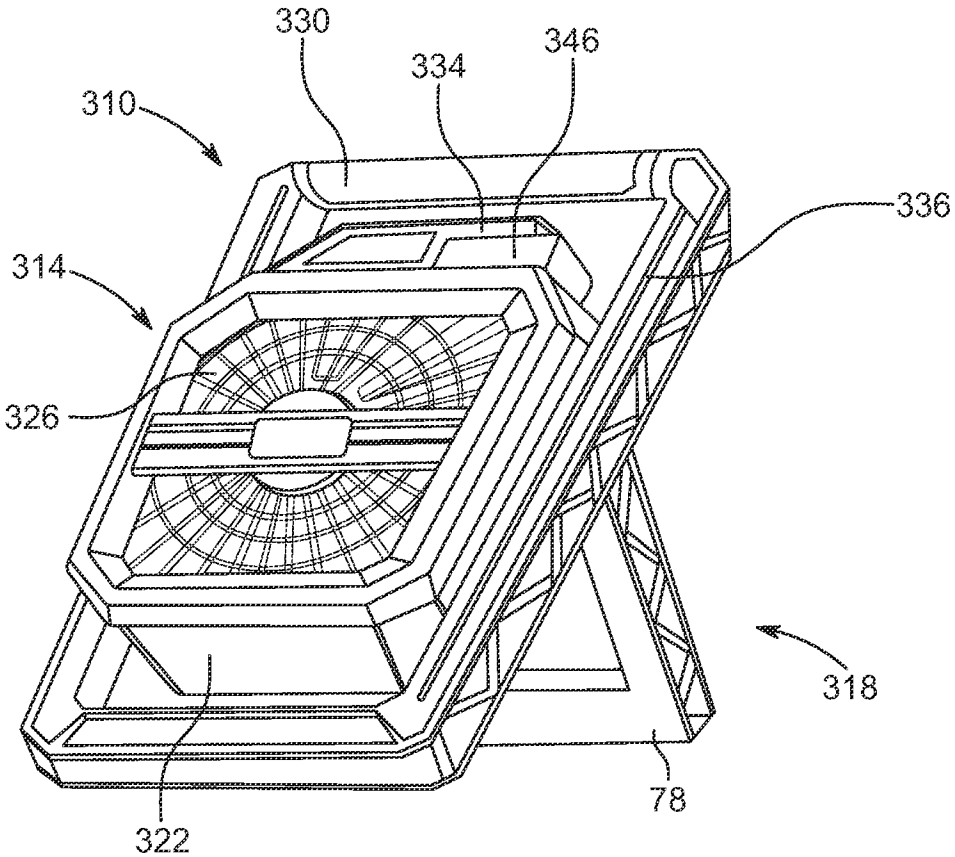
FIG. 11 is a perspective view of a fan assembly, including a housing and a base, according to another embodiment.

FIGS. 11 and 12 illustrate a fan assembly 310 according to another embodiment. The fan assembly 310 of FIGS. 11 and 12 is similar to the fan assembly 10 described above with reference to FIGS. 1-6, and similar features are identified with similar reference numbers, plus "300." Some differences between the fan assembly 10 and the fan assembly 310 are described.

As shown in FIGS. 11 and 12, the fan assembly 310 is positionable in various orientations including, for example, an angled upright or expanded position (FIG. 11), a generally flat or collapsed position (FIG. 12), or another position not illustrated (e.g., a partially expanded position, a partially collapsed position, etc.).

Referring to FIG. 11, the fan assembly 310 includes a housing 314 and a base 318. As with the embodiment described with reference to FIG. 9, the housing 314 is generally polygonal and includes a shroud 322, a grille 326, and a battery receptacle 334. The base 318 may include a support bar 336 forming a generally square perimeter which surrounds the housing 314 in both the example expanded and collapsed positions. The perimeter of the support bar 336, as shown in FIG. 12, extends beyond an overall dimension of the housing 314.

The base 318 further includes a stand 78 rotatably attached to the base 318. As shown in FIG. 11, the stand 78 is configured to support the housing 314 and base 318 against a surface at a desired angle. As shown in FIG. 12, the stand 78 may also be received in the base 318 while in the collapsed position to reduce the side/profile of the fan assembly 310. The base 318 may also serve as a carrying handle 330 for the fan assembly 310.

Figure 14:
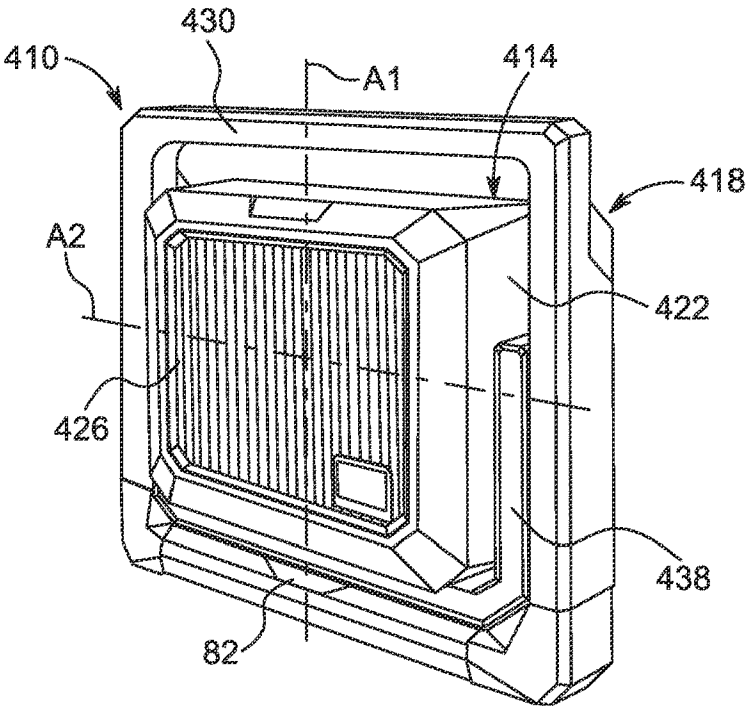
FIG. 14 is perspective view of the fan assembly of FIG. 13 in a collapsed configuration.
Figure 13:
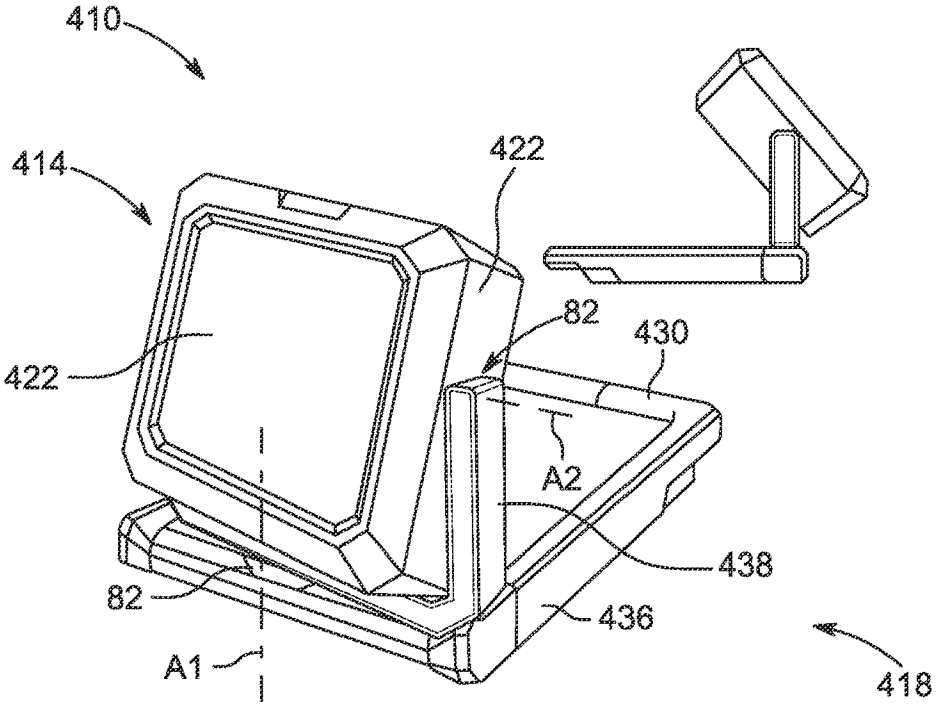
FIG. 13 is a perspective view of a fan assembly, including a housing and a base, according to another embodiment, and also illustrating a side view of the fan assembly.

FIGS. 13 and 14 illustrate a fan assembly 410 according to another embodiment. The fan assembly 410 of FIGS. 13 and 14 is similar to the fan assembly 10 described above with reference to FIGS. 1-6, and similar features are identified with similar reference numbers, plus "400." Some differences between the fan assembly 10 and the fan assembly 410 are described.

Similar to the embodiments above, as shown in FIGS. 13 and 14, the fan assembly 410 is positionable in various orientations including, for example, an angled upright or expanded position (FIG. 13), a generally flat or collapsed position (FIG. 14), or another position not illustrated (e.g., a partially expanded position, a partially collapsed position, etc.).

Referring to FIG. 13, the fan assembly 410 includes a housing 414 and a base 418. As with the embodiment described with reference to FIG. 11, the housing 414 is generally polygonal and includes a shroud 422, a grille 426, and a battery receptacle. The base 418 may include a support bar 436 forming a generally square perimeter which surrounds the housing 414 in the example collapsed positions. The perimeter of the support bar 436, as shown in FIG. 14, extends beyond an overall dimension of the housing 414.

With continued reference to FIG. 13, the base 418 may further include a yoke 438 (e.g., yoke linkage or joint) pivotally supported by the support bar 436 at one end that rotatably supports the housing 414 at an opposite end. The yoke 438 is pivotally mounted relative to the base 418 to pivot about a first axis A1, while the housing 414 is rotatably mounted relative to the yoke 438 to rotate about a second axis A2. In the illustrated embodiment, axis A1 and axis A2 extend perpendicularly to one another. In other words, the housing 414 is adjustable relative the base 418 in horizontal and vertical directions. Alternatively, the yoke 438 may be omitted such that the housing 414 is more simply rotatable about a single axis, similar to the fan assembly 210 discussed with respect to FIG. 7, in one example.

As shown in FIG. 14, the yoke 438 is further attached to a joint 82 that is hingedly supported within the base 418. The joint 82 allows the yoke 438 and housing 814 to be selectively swung between the example upright position (FIG. 13) and the example collapsed position (FIG. 14). As further shown in FIG. 14, the base 418 may also serve as a carrying handle 430 for the fan assembly 410.

Figure 16:
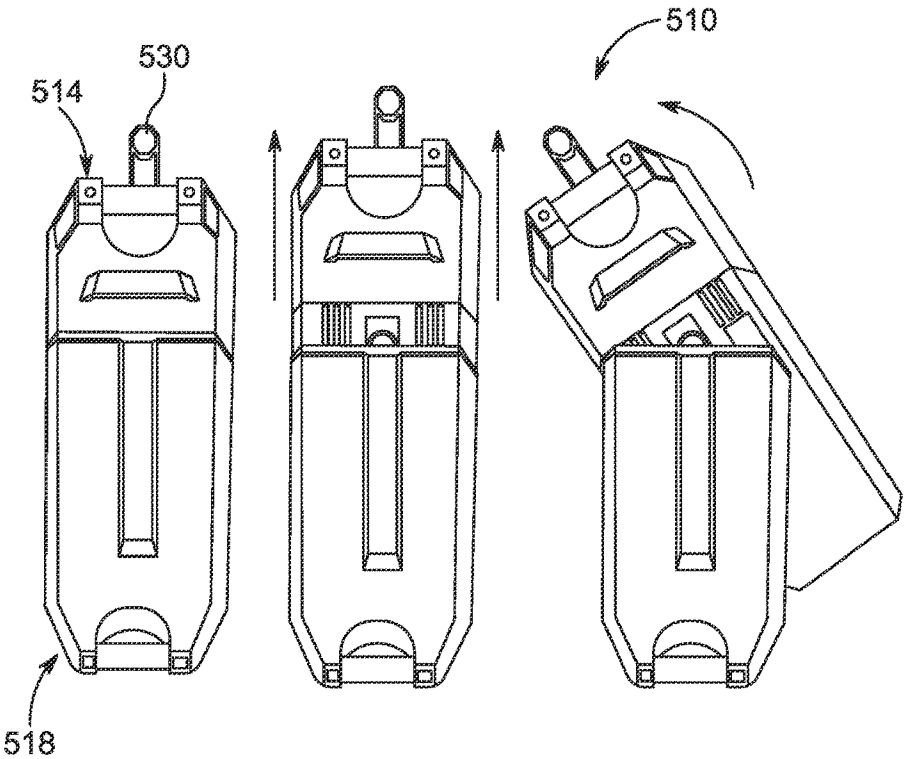
FIG. 16 is side view of the fan assembly of FIG. 15, illustrating one example operation of moving the housing, with respect to the modular base, between example positions.
Figure 15:
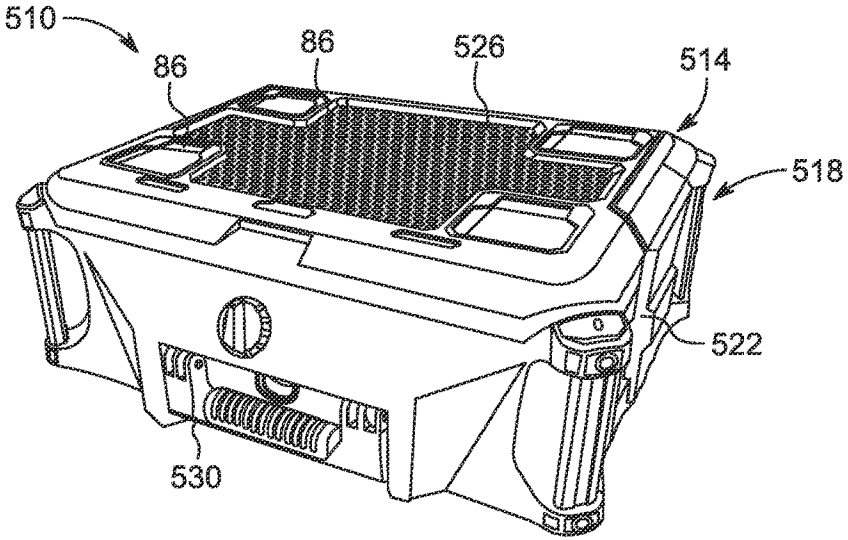
FIG. 15 is a perspective view of a fan assembly, including a housing and a modular base, according to another embodiment, illustrating the housing nested in the modular base.

FIGS. 15 and 16 illustrate a fan assembly 510 according to another embodiment. The fan assembly 510 of FIGS. 15 and 16 is similar to the fan assembly 10 described above with reference to FIGS. 1-6, and similar features are identified with similar reference numbers, plus "500." Some differences between the fan assembly 10 and the fan assembly 510 are described.

Similar to the embodiments above, as shown in FIGS. 15 and 16, the fan assembly 510 is positionable in various orientations including, for example, an angled upright or expanded position (FIG. 16), a generally flat or collapsed position (FIG. 15), or another position not illustrated (e.g., a partially expanded position, a partially collapsed position, etc.).

Referring to FIG. 15, the fan assembly 510 includes a housing 514 and a modular base 518. As with the embodiment described with reference to FIG. 11, the housing 514 is generally polygonal and includes a shroud 522, a grille 526, one or more handles 530, and a battery receptacle. The grille 526 includes mating features 86 integrally formed thereon. The mating features 86 are configured to enable stacking engagement and mating between the fan assembly 510 and another element such as another fan, a storage container, a radio, an open top crate, or the like. The mating features 86 may provide a mating interface similar to the Milwaukee PACKOUT Modular Tool Box Storage System commercialized by Milwaukee Electric Tool Corporation. A complimentary mating interface may also be formed on a lower portion of the modular base 518 to allow stacking engagement with a lower stacking element, such that the fan assembly 510 may stack on and mate with another element or have another element stacked on and mated to the grille 526/mating features 86.

As shown in FIG. 16, the housing 514 may make up a portion of the overall polygonal perimeter of the fan assembly 510. In the illustrated embodiment, the housing 514 is at least partially nested in the modular base 518 while in the collapsed position (FIG. 15). In order to transition the fan assembly 510 into the expanded position, in one example operation, the housing 514 is operated away from the modular base 518, which provides clearance for the housing 514 to rotate relative the modular base 518. After sufficient separation, the housing 514 may then be rotated to an angled position, as shown in FIG. 16. It should be understood that any of the discussed configurations/methods for retaining the housing 514 in a desired orientation are contemplated for each embodiment. For example, the housing 514 shown in FIG. 16 could be help in a desired position through a friction force, a tightening knob, and/or another type of brake/resistor. The fan assembly 510 may further include one or more internal compartments configured to receive a battery. One or more of the internal compartments may also serve as a storage compartment for storing an accessory such as a tool bit, a tool, or the like.

Figure 17:
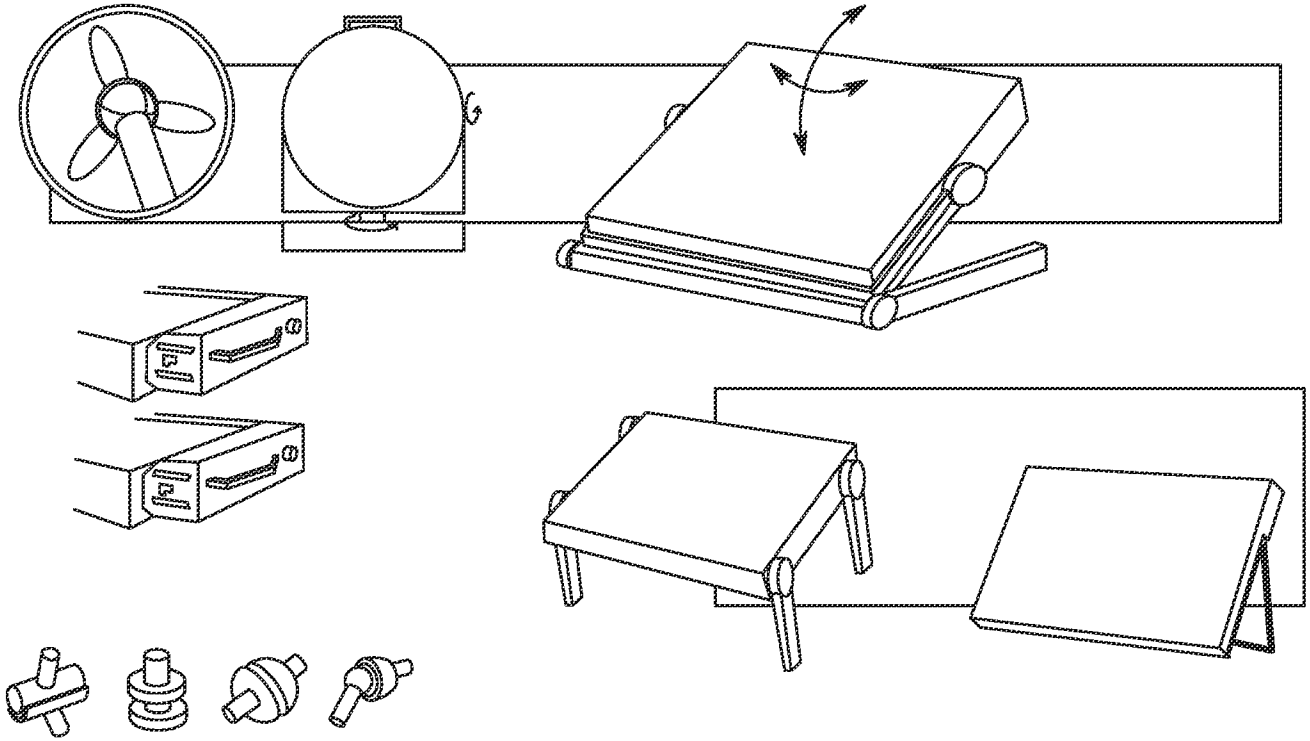
FIGS. 17-24 illustrate example constructions of fan assemblies, according to other embodiments.

With reference to FIGS. 17-24, various embodiments and/or constructions of cooling apparatuses are contemplated. FIG. 17 illustrates a fan assembly having an ON/OFF switch positioned on a grille; a fan assembly configured to interface with a drawer assembly, a fan incorporating a variety of joints, such as a universal joint between a base and a housing, for example; and a fan assembly having one or more rotatable kick-stands.

Figure 18:
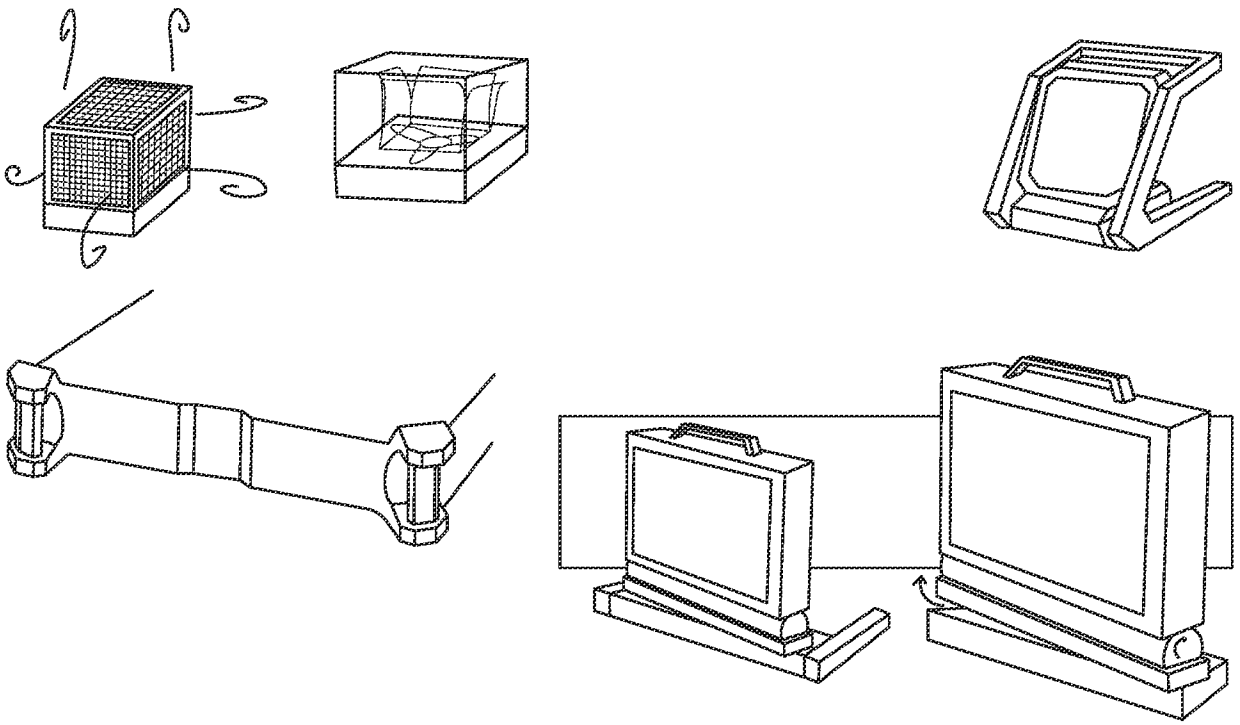

FIG. 18 illustrates a global output type fan assembly (e.g., airflow projecting in opposing and orthogonal directions); a fan assembly having corner handles; a fan assembly rigidly supported in an angled position; and a fan assembly incorporating a joint with two or more degrees of freedom.

Figure 19:
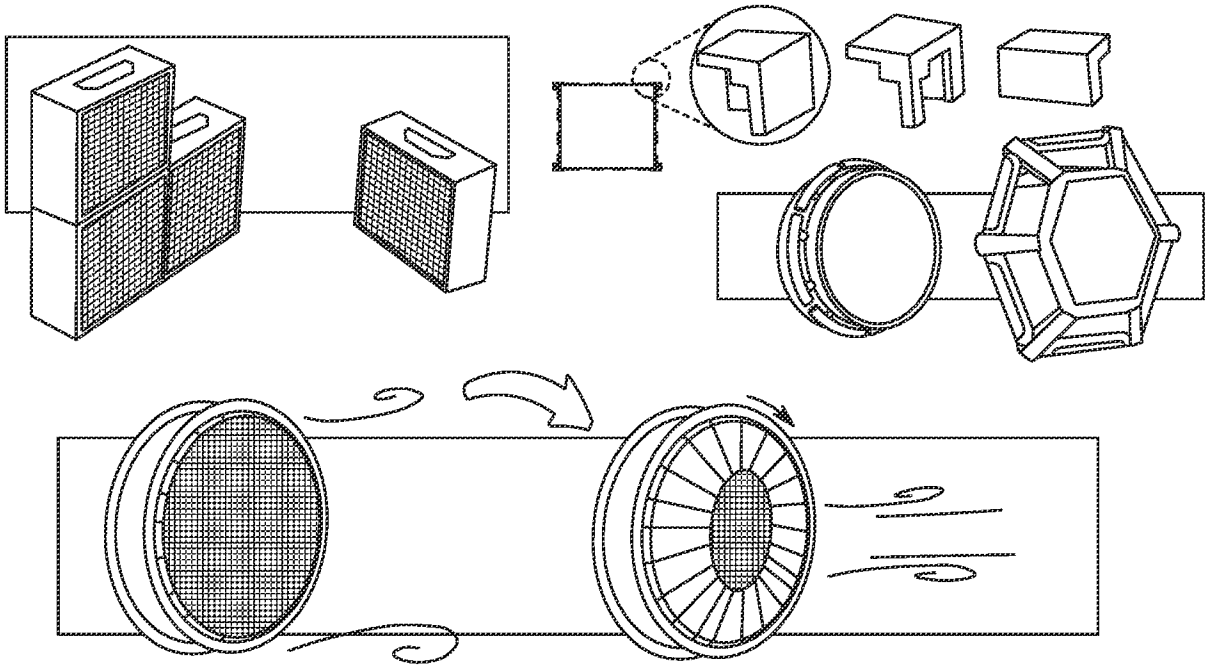

FIG. 19 illustrates a system of modular fan assemblies each having a box-like profile; a fan assembly including a right-angled construction for supporting the fan assembly on a corner or ledge surface; a fan assembly having a hexagonal shaped grille/housing; and a fan assembly including a grille having a constricted air flow cross-section configured to narrow generated airflow.

Figure 20:
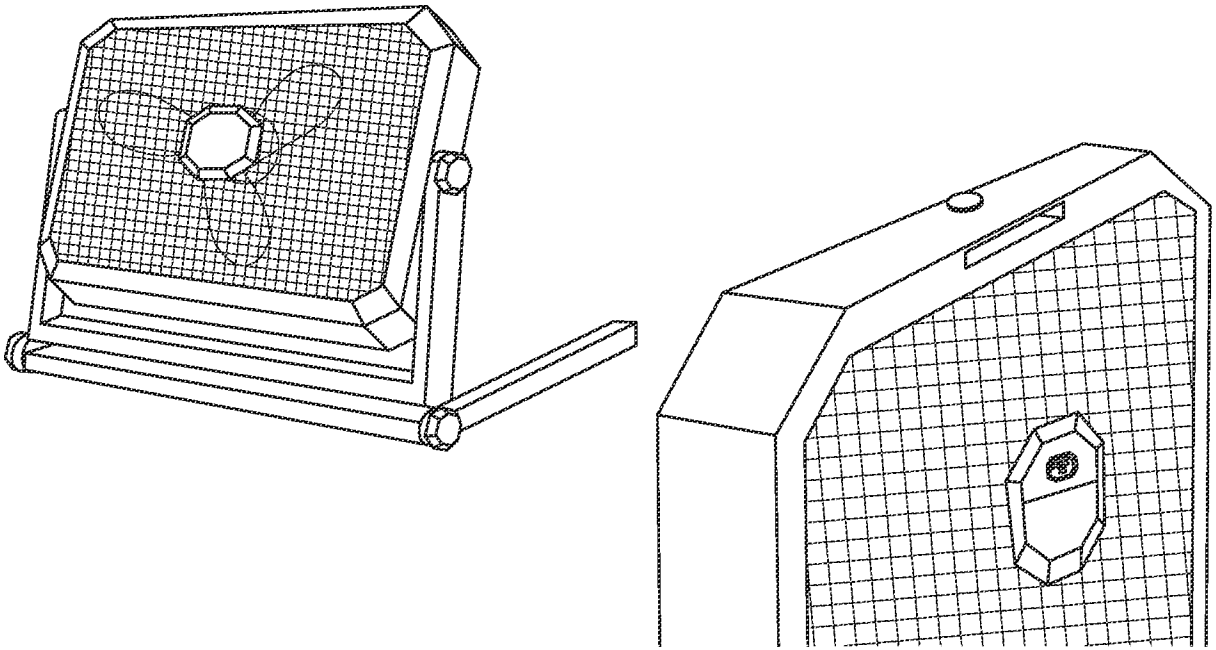

FIG. 20 illustrates a fan assembly substantially similar to the embodiment discussed with respect to FIG. 13, including a universal-type joint and a narrow or slim profile, particularly when in a collapsed or storable position.

Figure 21:
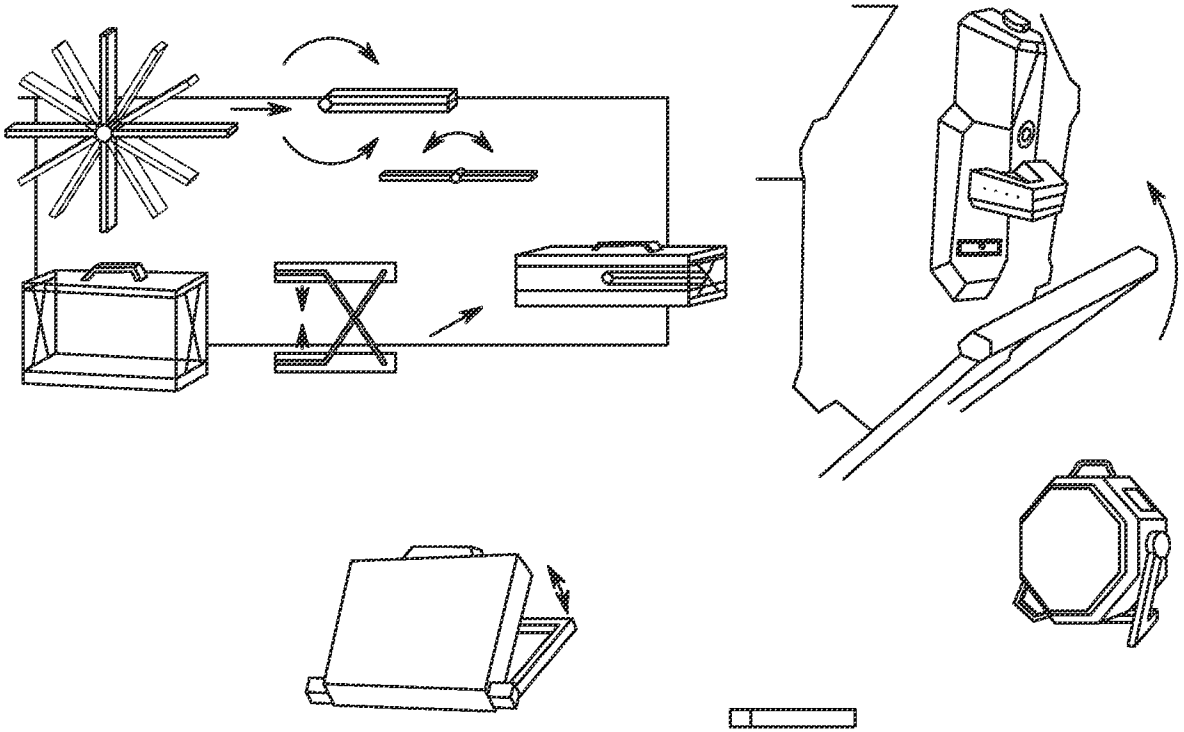

FIG. 21 illustrates a fan assembly incorporating a scissors-jack type adjusting mechanism that extends between an expanded position and a collapsed position in which the members of the scissors-jack are fully retained within a housing of the fan assembly; a briefcase type fan collapsible to a flat position having an overall profile similar to an overall profile of a briefcase in which that fan may be set directly on a surface and to blow air upwards in a direction perpendicular to the surface; a fan assembly supporting a battery pack charging assembly; and a fan assembly substantially the same as the embodiment discussed with respect to FIG. 1, including a hexagonal shroud rather than a circular shroud.

Figure 22:
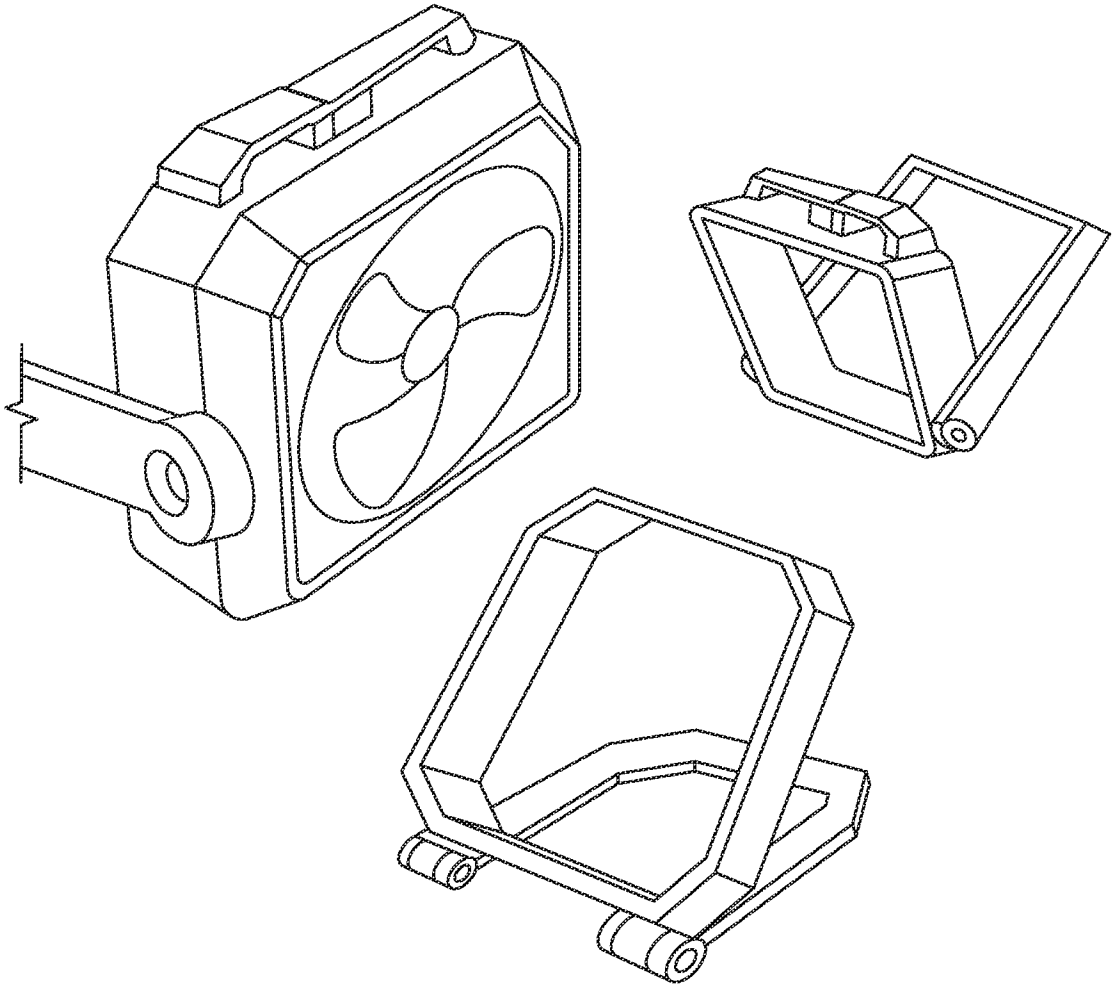

FIG. 22 illustrates a stowable and folding fan assembly incorporating multiple handles, a folding base, a modular housing configured to selectively receive a replacement fan module, and one or more lights.

Figure 23:
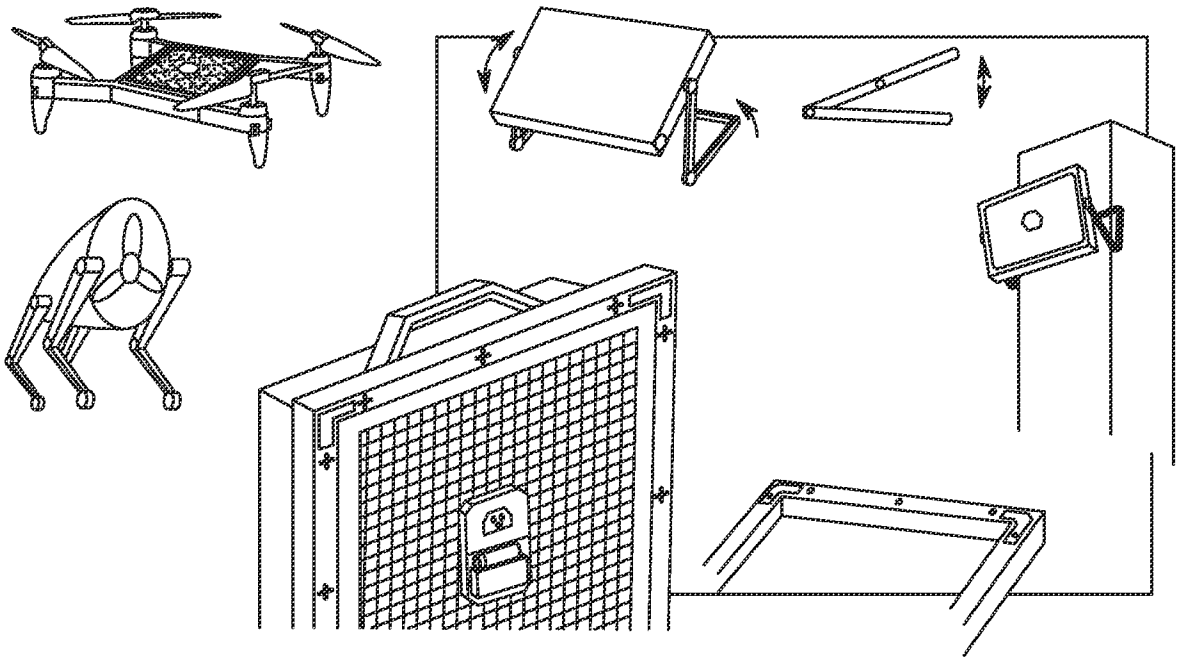

FIG. 23 illustrates a collapsible drone including rotors/propellers and a solar panel configured to power the drone and/or charge a removable battery pack; an autonomous mobile fan assembly having moveable legs configured to transport the fan assembly; a wall mounted fan assembly sustainably similar to the embodiment discussed with respect to FIG. 1, including a wall mount; and a low profile fan assembly having an AC receptacle configured to output power from the fan assembly.

Figure 24:
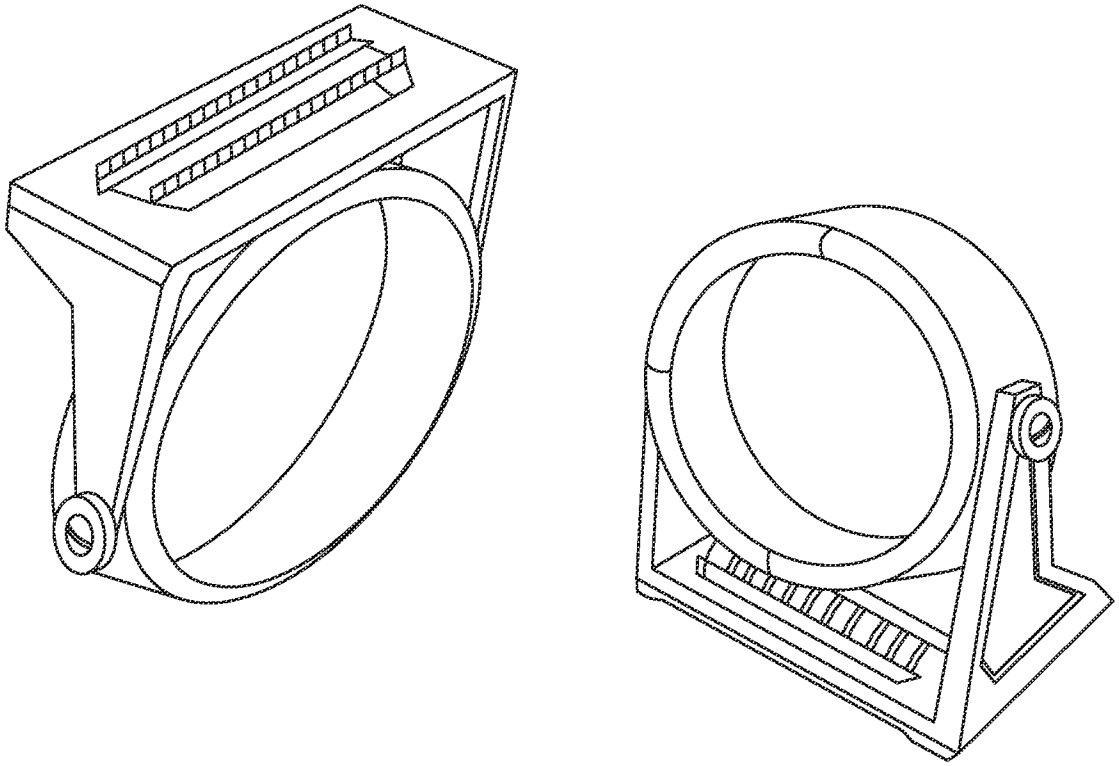

FIG. 24 illustrates a fan assembly including a shroud and an adjustable base having one or more additional air flow channels integrally formed therein.

Figure 25:
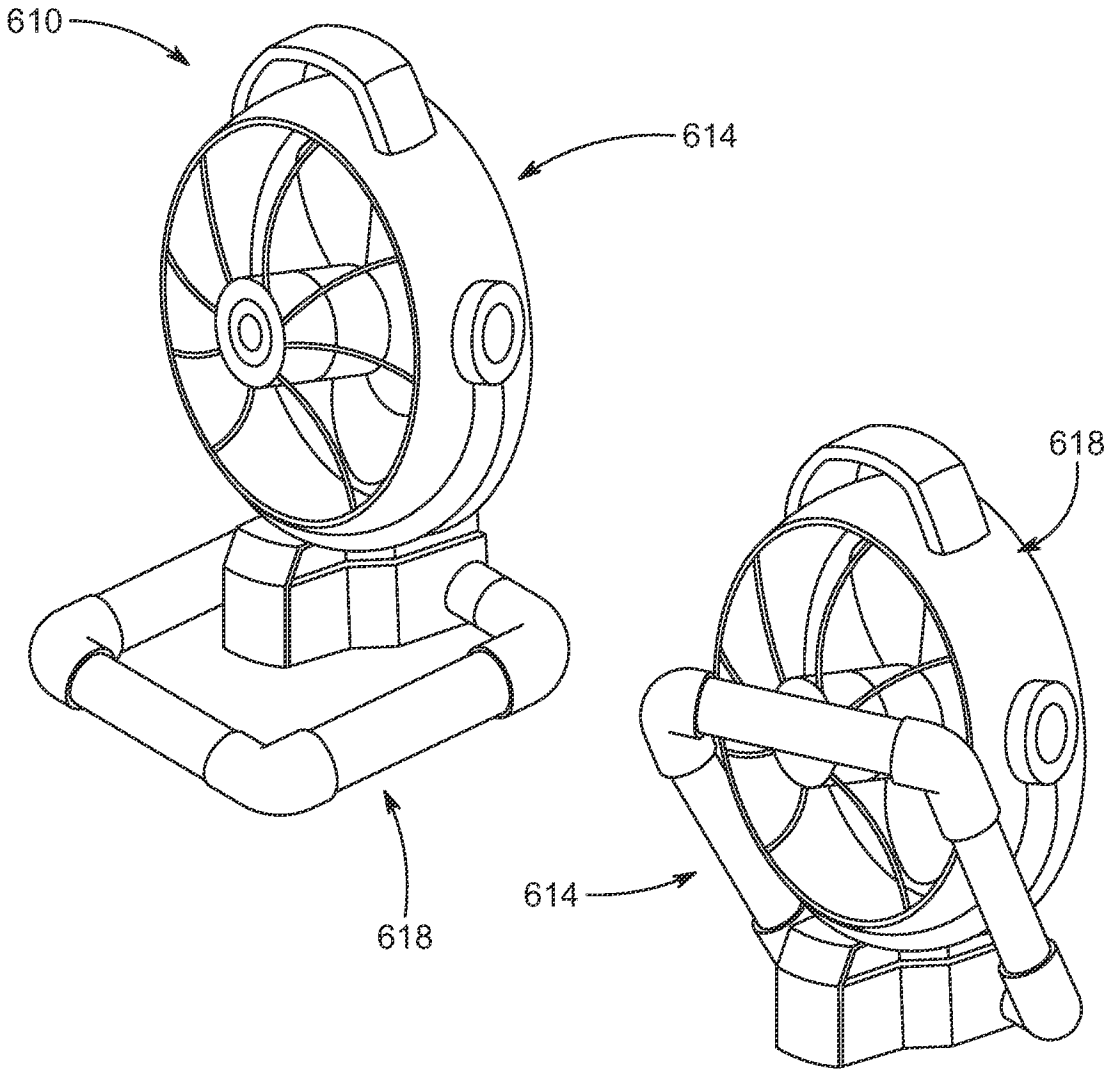
FIG. 25 is a perspective view of a fan assembly, including a housing and a base, according to another embodiment, illustrating the fan assembly in two possible configurations.
Figure 26:
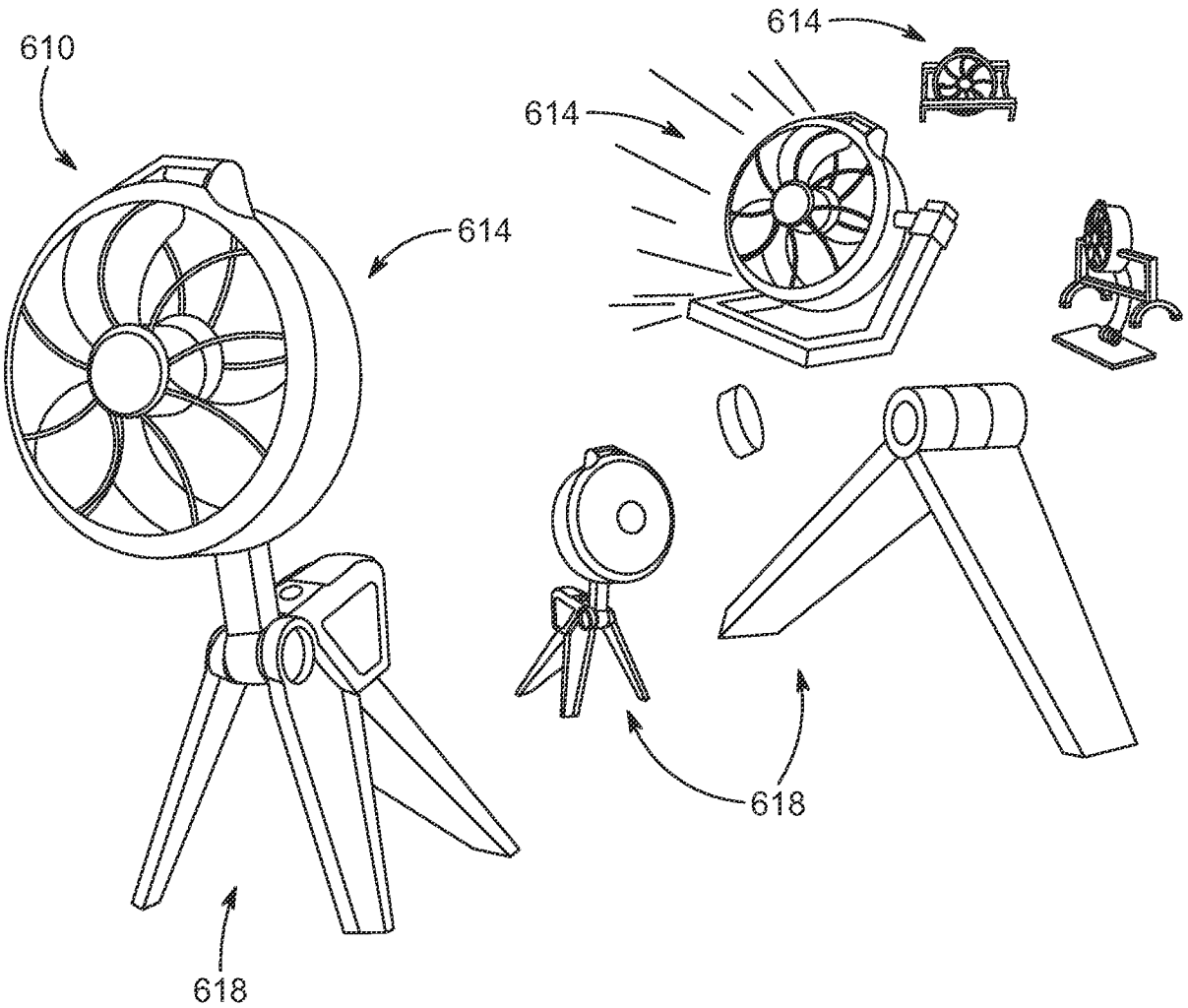
FIG. 26 is a perspective view of the fan assembly of FIG. 25, illustrating a variety of bases useable with the fan assembly.

FIGS. 25 and 26 illustrate a system and fan assembly 610 according to another embodiment. The fan assembly 610 of FIGS. 25 and 26 is similar to the fan assembly 10 described above with reference to FIGS. 1-6, and similar features are identified with similar reference numbers, plus "600." Some differences between the fan assembly 10 and the fan assembly 610 are described.

Similar to the embodiments above, as shown in FIGS. 25 and 26, the fan assembly 610 is positionable in various orientations including, for example, an angled upright or expanded position, a collapsed position, or another position not illustrated (e.g., a partially expanded position, a partially collapsed position, etc.).

With reference to FIGS. 25 and 26, the fan assembly 610 includes a housing 614 and a base 618 that is modular/interchangeable with the housing 614. The base 618 may include, as illustrated in FIG. 26, any one of a generally square pipe base, a tri-pod base, a bi-pod base, a cantilever base, or the like. Each base 618 may be selectively and removably coupled (e.g., interchangeable) to the housing 614 and transformed between multiple positions (e.g., collapsed position, extended position, rotated position, etc.).

Figure 27:
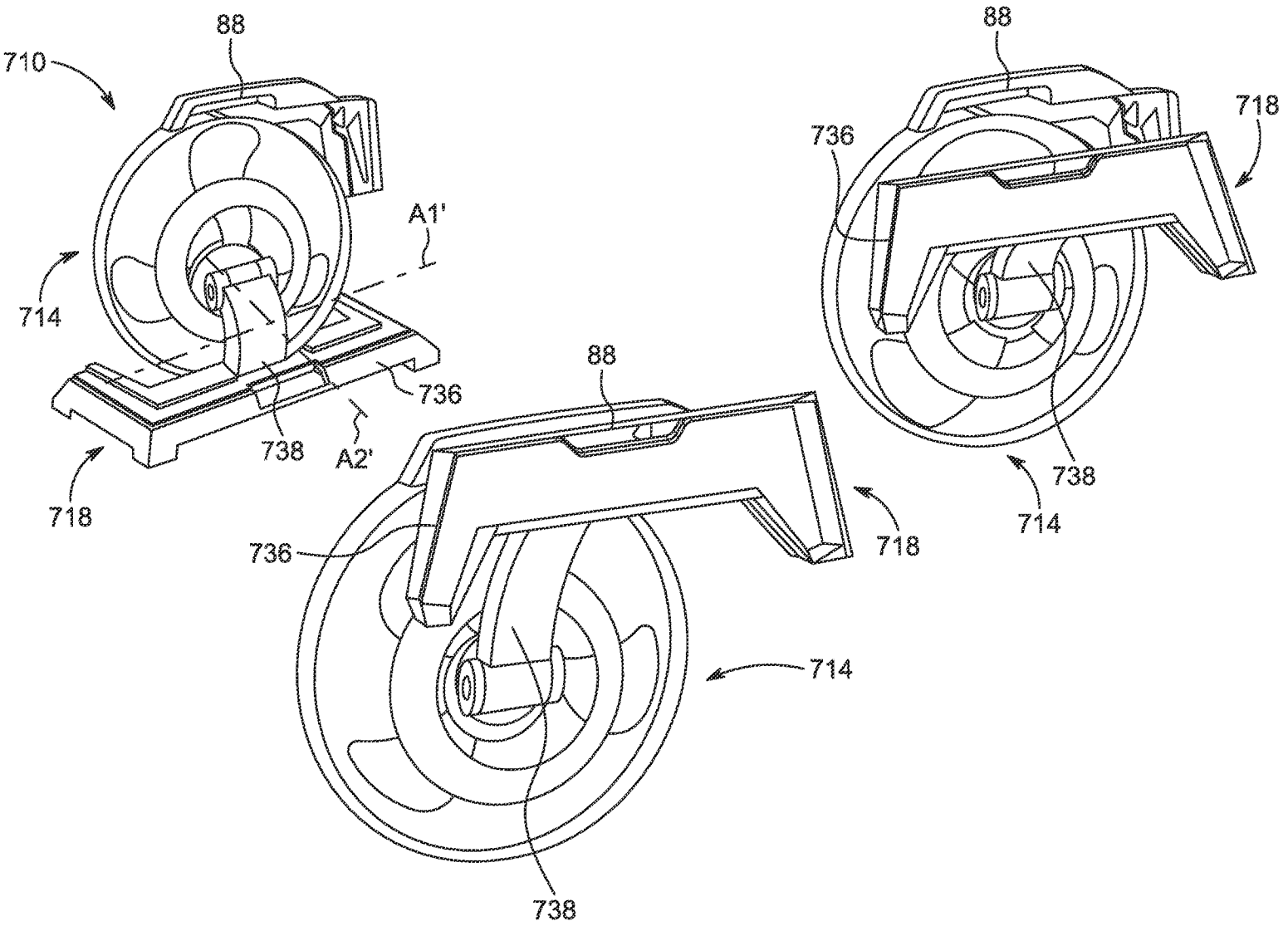
FIG. 27 is a perspective view of a fan assembly, including a housing and a base, according to another embodiment, illustrating the fan assembly in possible configurations.

FIG. 27 illustrates a fan assembly 710 according to another embodiment. The fan assembly 710 of FIG. 27 is similar to the fan assembly 10 described above with reference to FIGS. 1-6, and similar features are identified with similar reference numbers, plus "700." Some differences between the fan assembly 10 and the fan assembly 710 are described.

Similar to the embodiments above, as shown in FIG. 27, the fan assembly 710 is positionable in various orientations including, for example, an angled upright or expanded position, a collapsed position, or another position not illustrated (e.g., a partially expanded position, a partially collapsed position, etc.).

With reference to FIG. 27, the fan assembly 710 includes a housing 714 and a base 718. The base 718 is configured to support the housing 714 in multiple configurations, including a surface mount configuration, an extended wall mount configuration, and a retracted wall mount configuration. The base 718 may further include a support bar 736 and a linkage 738 pivotally supported by a support bar 736. The linkage 738 pivotally and rotatably supports the housing 714 at one end and is pivotally supported by the support bar 736 at an opposite end. The linkage 738 is pivotally mounted relative to the base 718 to pivot about a first axis A1', while the housing 714 is rotatably mounted relative to the linkage 738 to rotate about a second axis A2'. Further, the linkage 738 is pivotally mounted relative to the base 718 to pivot about the first axis A1'. Stated another way, the base 718 may be rotated about the second axis A2' to be selectively positioned relatively above or below the housing 714. The base 718 may further include a mounting aperture 88 for mounting the fan assembly 710 to a vertical or wall surface.

Figure 28:
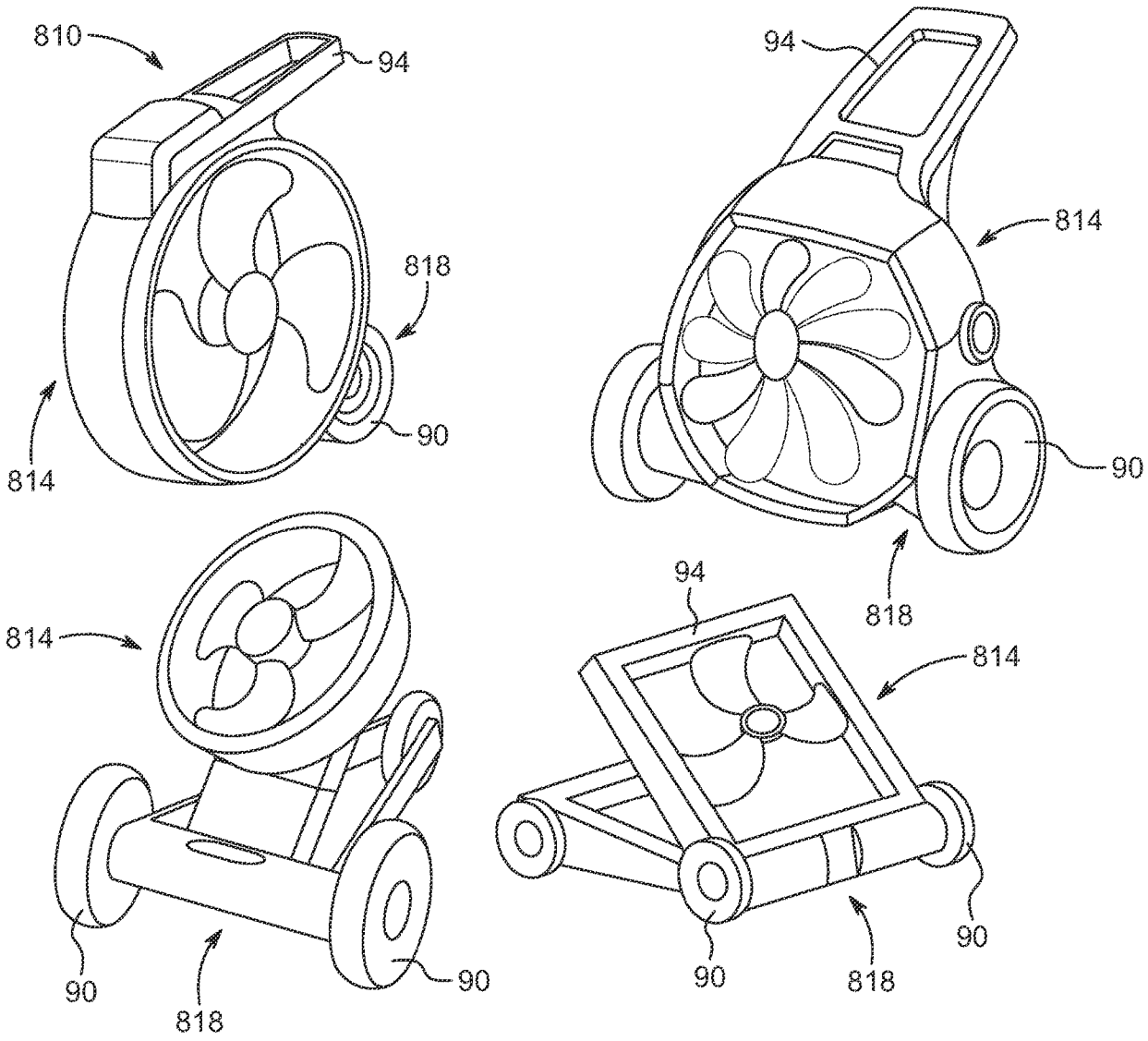
FIG. 28 is a perspective view of a fan assembly, including a housing and a wheeled base, according to other embodiments, illustrating the fan assembly in some possible configurations and constructions.

FIG. 28 illustrates a fan assembly 810 according to another embodiment. The fan assembly 810 of FIG. 28 is similar to the fan assembly 10 described above with reference to FIGS. 1-6, and similar features are identified with similar reference numbers, plus "800."

With reference to FIG. 28, the fan assembly 810 includes a housing 814 and a variety of bases 818. The bases 818 include various collapsible and configurable mobile wheeled bases. The bases 818 may include supports for rotatable or rigidly supporting the housing 814, one or more ground engaging members 90 (e.g., wheels, casters, tracks, or the like), and a rigid or manually engageable pulling handle 94. It should be stated that the bases 818 could be incorporated with any of the embodiments discussed herein.

FIGS. 29-35 illustrate a fan assembly 1010 according to another embodiment. The fan assembly 1010 of FIGS. 29-35 is similar to the fan assembly 10 described above with reference to FIGS. 1-6, and similar features are identified with similar reference numbers, plus "1000." Some differences between the fan assembly 10 and the fan assembly 110 are described.

Referring to FIGS. 29-32, the fan assembly 1010 includes a housing 1014 and a base 1018 that is configured to support the housing 1014 in multiple predetermined configurations (e.g., orientation, height, direction, etc.). The housing 1014 includes a shroud 1022, one or more grilles 1026, a handle 1030, and a battery receptacle 1034. The illustrated shroud 1022 is generally cylindrical and includes a flared end at an inlet of the shroud 1022. As such, the inlet of the shroud 1022 has a larger area than an outlet of the shroud 1022. In other embodiments, the shroud 1022 may have other shapes or configurations (e.g., square, rectangular, oblong, and the like). In the illustrated embodiment, the battery receptacle 1034 is supported on a circumferential wall of the housing 1014, and more particularly, on the shroud 1022. The base 1018 includes a support bar 1036 and linkages 1038 that are moveably (e.g., rotatable) attached to the support bar 1036 and to the housing 1014 to retain the housing 1014 in a desired configuration. The handle 1030 may extend between the battery receptacle 1034 and the shroud 1022. More particularly, the handle 1030 may be coupled to a circumferential surface of the shroud 1022 at one end and coupled to a relatively flat surface of the battery receptacle 1034 at a second, opposing end. In some embodiments, the handle 1030 and battery receptacle 1034 may be integrally formed together by two housing shells 1030*a*, 1030*b* (FIG. 30) that are coupled to the shroud 1022.

As shown in FIGS. 29-33, the fan assembly 1010 is positionable in various orientations including, for example, an angled upright position (FIG. 33), a generally flat position (FIGS. 29-32), an upward-facing position (FIG. 33), a downward-facing position (FIG. 33), and other positions and intermediate positions not specifically illustrated (e.g., a partially expanded position, a partially collapsed position, etc.).

Figure 30:
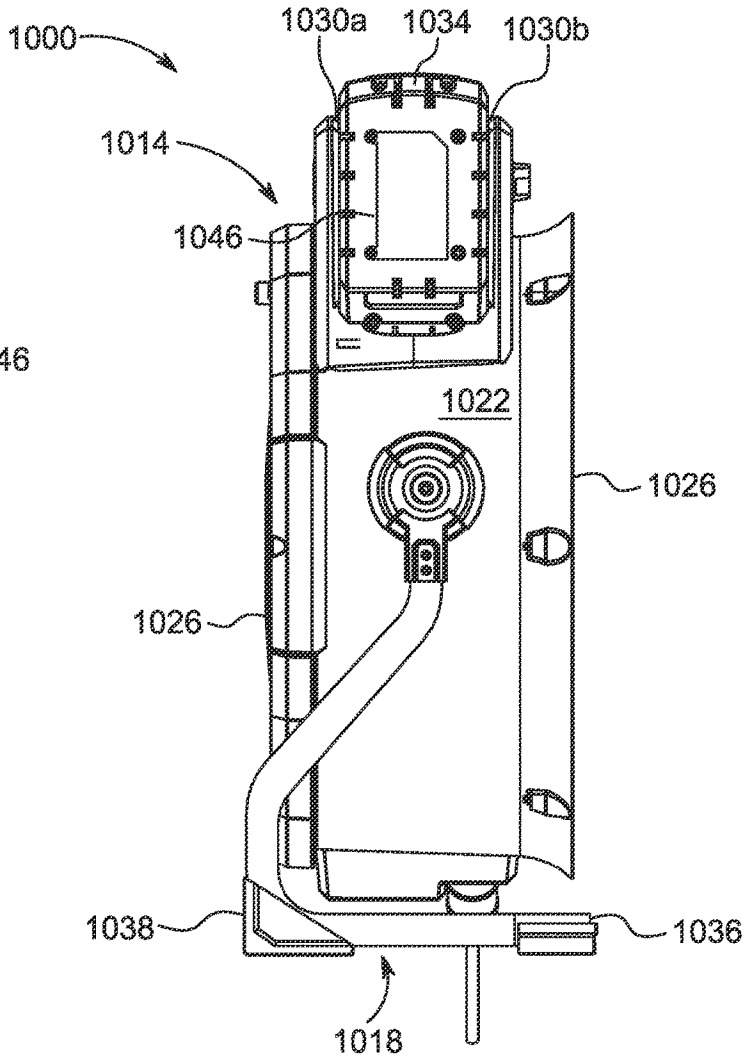
FIG. 30 is side perspective view of the fan assembly of FIG. 29.
Figure 29:
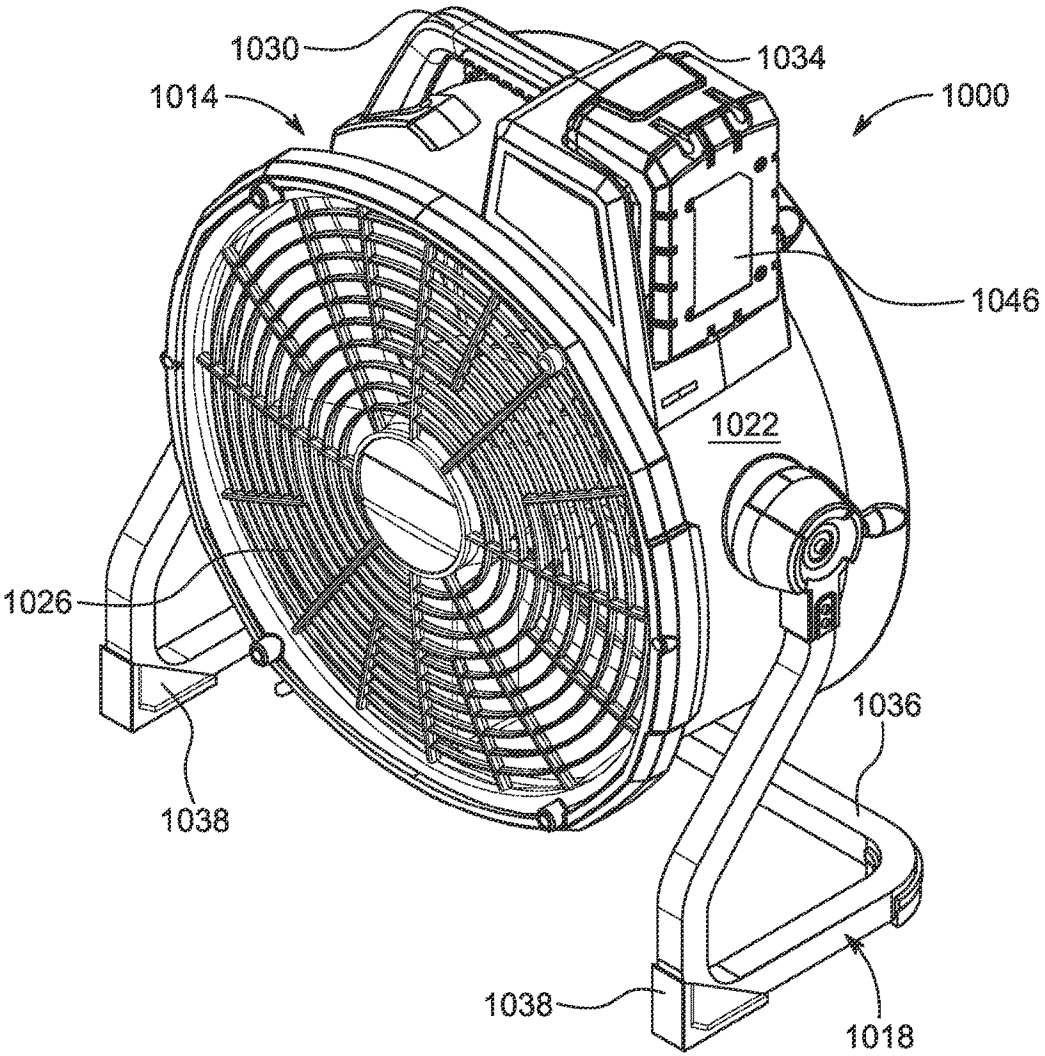
FIG. 29 is a perspective view of a fan assembly, including a housing and an adjustable base, according to another embodiment.

In the illustrated embodiment, the support bar 1036 forms a generally rectangular perimeter which provides a support surface for the fan assembly 1010 while in use or storage. The perimeter of the support bar 1036, as shown in FIG. 30, does not extend beyond an overall dimension of the housing 1014 when flat such that the housing 1014 may be received within the perimeter while in the example flat position. In some embodiments, an overall profile of the fan assembly 1010 may be reduced to allow for easier storage and/or transportation of the fan assembly 1010.

In the illustrated embodiment, the linkages 1038 are supported by the support bar 1036 at one end and rotatably support the housing 1014 at an opposite end. In the illustrated embodiment, the housing 1014 is rotatable relative to the linkages 1038. Some friction exists within the rotatable connections made between the linkages 1038 and the housing 1014 such that some amount of friction force must be overcome for rotation to occur. Alternatively, the linkages 1038 may be coupled to the housing 1014 by a detent mechanism. Such connections allow the fan assembly 1010 to be set and held in a desired position. In some embodiments, the housing 1014 may be rigidly supported by the linkages 1038. In other embodiments, the connections between the housing 1014 and the linkages 1038 could be another type of connection such as a sliding connection, a magnetic coupling, a telescoping connection, or the like.

With continued reference to FIGS. 29-32, the base 1018 may selectively support the housing 1014 on a substantially horizontal surface (e.g., floor surface, tabletop, work bench, etc.). In other embodiments, the base 1018 includes a mounting assembly configured to mount the fan assembly 1010 to a vertical surface, such as a wall surface. In still other embodiments, the base 1018 includes a clamping assembly configured to mount the fan assembly 1010 to an edge surface, such as a plank, stud, desk edge, or the like.

Figure 34:
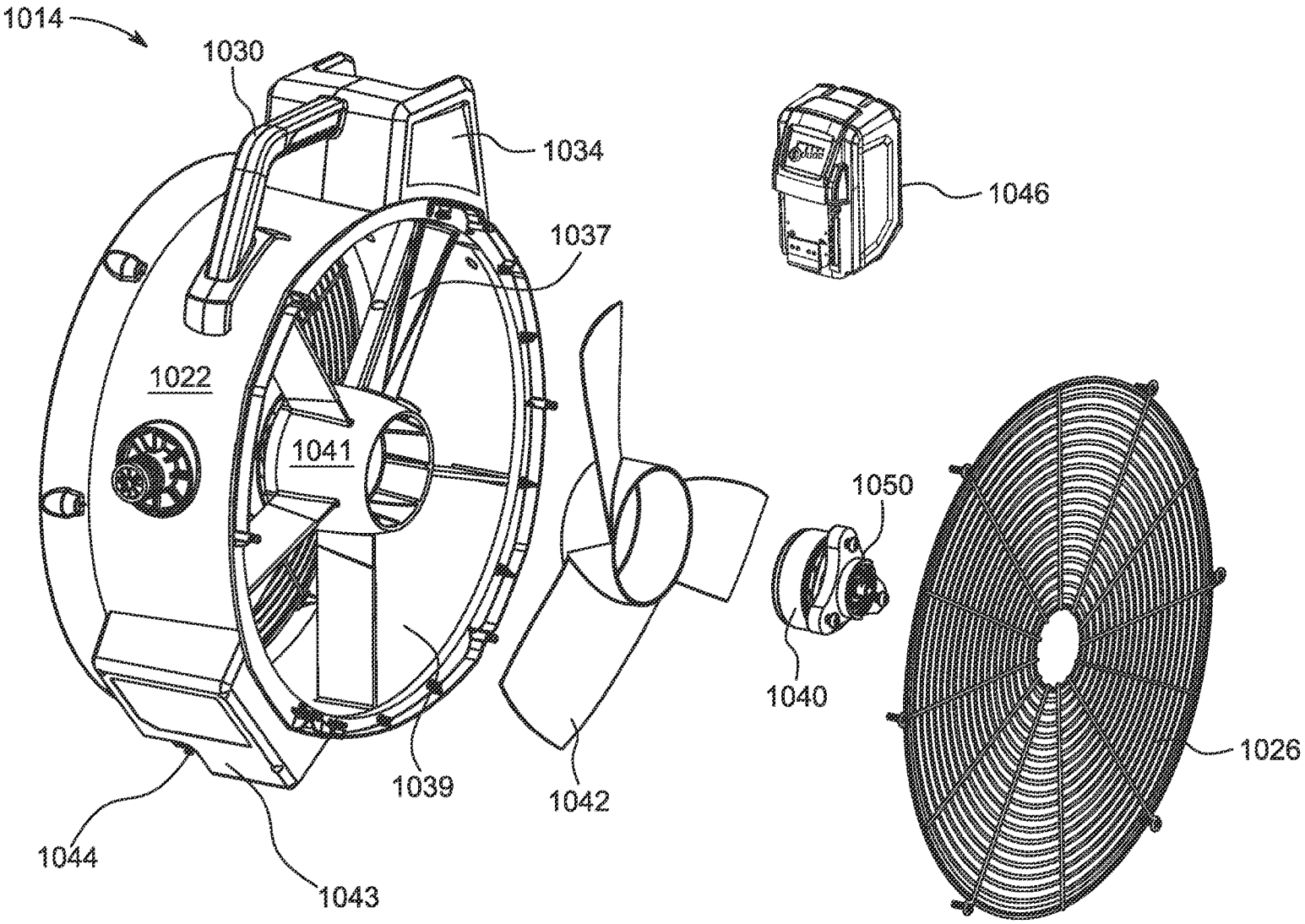
FIG. 34 is a partially exploded view of the fan housing of FIG. 29, illustrating a position of a motor, according to one example construction.
Figure 35:
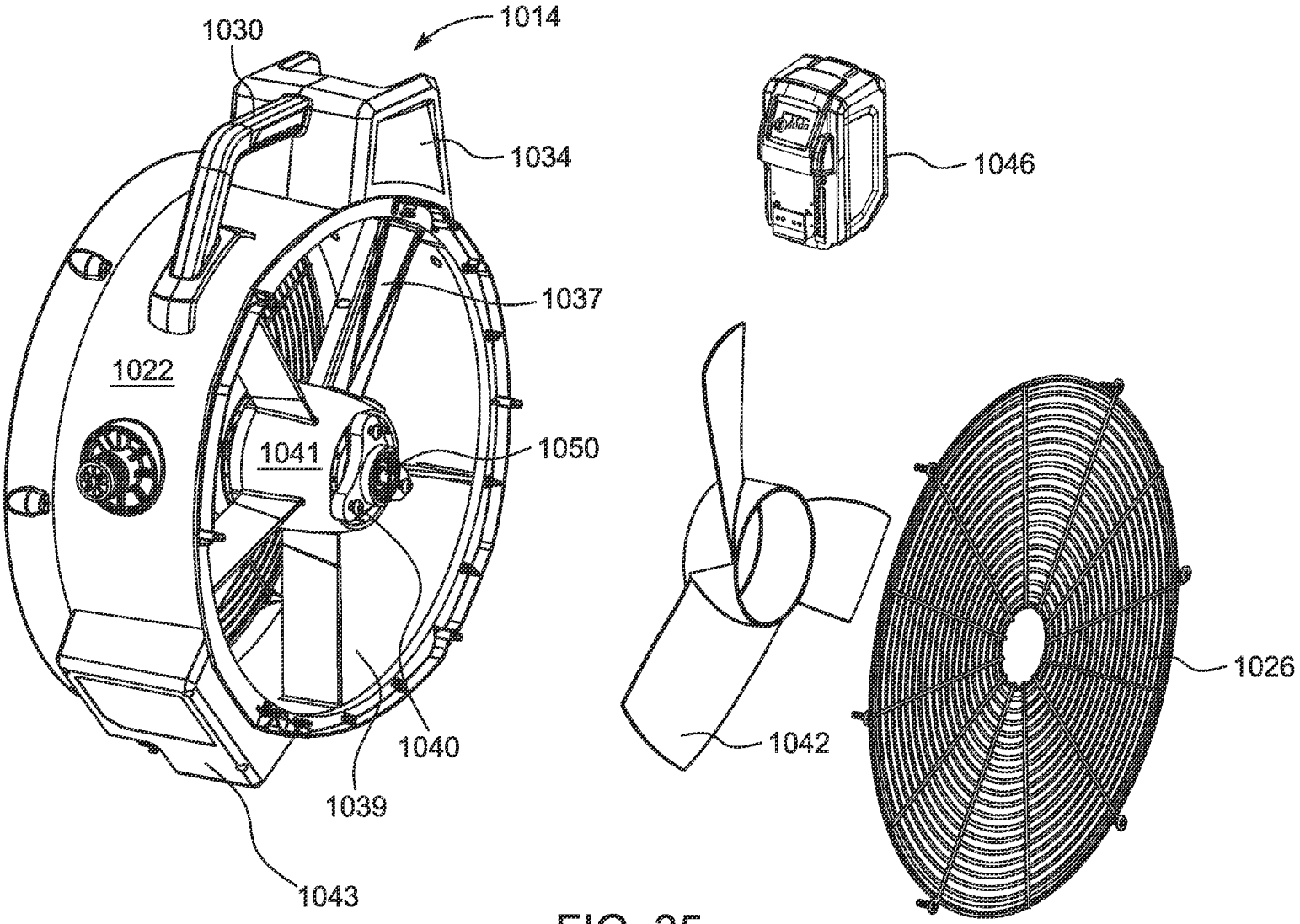
FIG. 35 is a partially exploded view of the fan housing of FIG. 29, illustrating an alternative position of the motor, according to another example construction.

Referring now to FIGS. 34 and 35, the housing 1014 further supports a motor 1040 and one or more blades 1042 rotatable by the motor 1040 to generate an airflow through an airflow chamber formed (e.g., defined) by the shroud 1022. In the illustrated embodiment, vanes 1037 extend inwardly from an outer wall 1039 of the shroud 1022 to a mount 1041. The vanes 1037 may be integrally formed with the outer wall 1039 or may be separate pieces that are secured to the outer wall 1039. The mount 1041 may also be integrally formed with the vanes 1037 or may be a separate piece that is secured to the vanes 1037. The mount 1041 may support the blades 1042 (FIG. 34) or the motor 1040 (FIG. 35), in some example constructions. The shroud 1022 may support the grilles 1026 at terminating ends, at a single end, or at a position between at terminating ends. In other embodiments, the blades may be arranged to generate an airflow across an airfoil (e.g., "bladeless" fan). In such embodiments, grilles may be omitted.

The motor 1040 may receive power from a battery pack 1046 selectively received by the battery receptacle 1034 to power the motor 1040 (e.g., rotation of the blades 1042). The illustrated battery pack 1046 is a removable, power tool battery pack (e.g., an 18 volt battery pack, as described above). In the illustrated embodiment, the battery pack 1046 slides into and out of the battery receptacle 1034 along an axis that is perpendicular to and offset from a rotational axis of the blades 1042. In other embodiments, the battery receptacle 1034 may have other configurations to receive different types of battery packs or to receive battery packs in different manners.

With reference to FIGS. 31-32 and 34-35, the housing 1014 even further supports an AC box 1043. The AC box 1043 may also be considered as a secondary power unit or an axillary power unit. In the illustrated embodiment, the AC box 1043 is supported on a side of the housing 1014 opposite from the battery receptacle 1034. More particularly, the AC box 1043 is positioned on a diametrically opposite side of the shroud 1022 from the battery receptacle 1034. Such an arrangement helps balance the weight of the AC box 1043 and the battery receptacle 1034 (and a connected battery pack 1046). In other embodiments, the AC box 1043 may be located elsewhere on the housing 1014. The AC box 1043 includes terminals 1044 (FIG. 34) configured to receive an electrical connector 1045 (FIGS. 31-32 and 35), such as a power cable or wire connectable to an external power source, such as a wall outlet, a generator, or the like. The AC box 1043 may be powered from the external power source to power the motor 1040 and other electrical components on the fan assembly 1010. The AC box 1043 may also be powered from the external power source to a charging unit configured to charge the battery pack 1046 (e.g., when received by the battery receptacle 1034). In the illustrated embodiment, the charging unit is provided within the battery receptacle 1034. In one example operation, the AC box 1043 is configured to simultaneously power the motor 1040 and charge the battery pack 1046. In some embodiments, when the AC box 1043 is connected to the external power supply, a user may select a motor operation mode, a battery pack 1046 charging mode, or a motor 1040 operation and battery pack 1046 charging mode.

Figure 31:
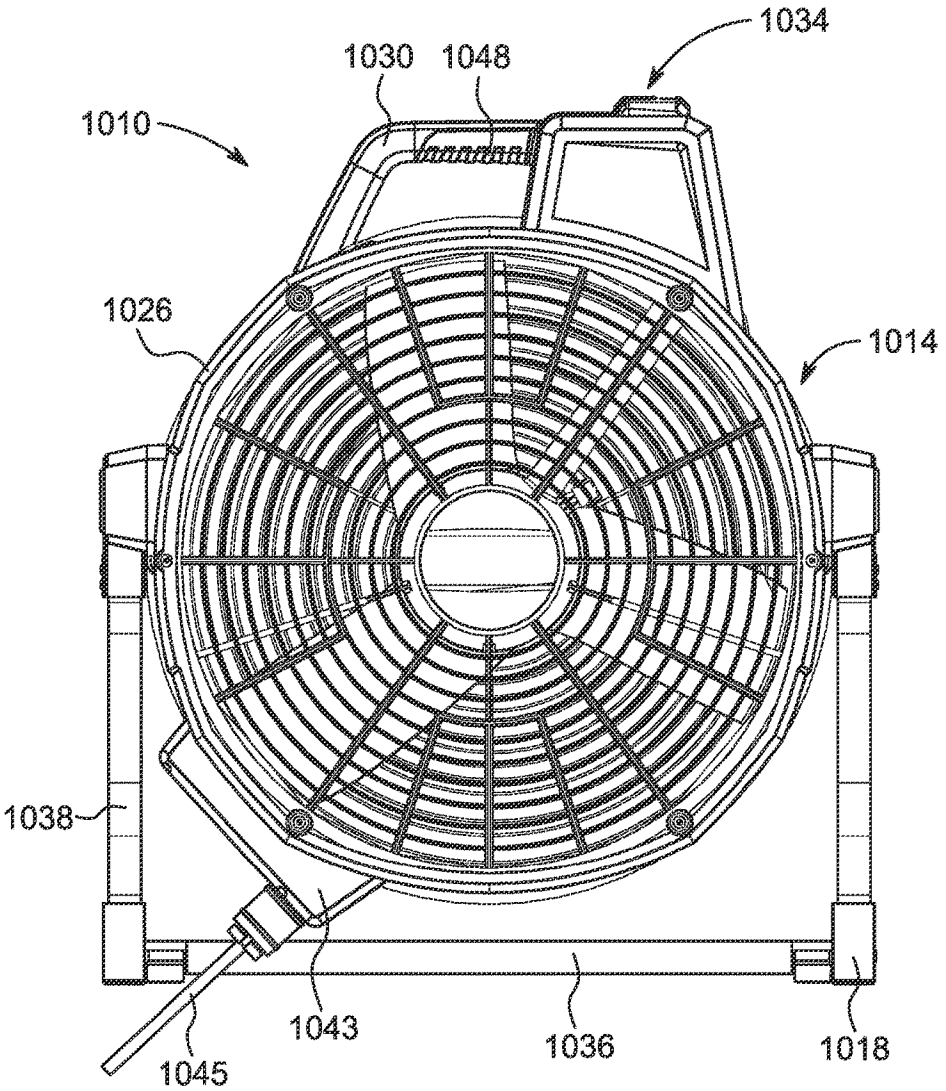
FIG. 31 is a front perspective view of the fan assembly FIG. 29.
Figure 32:
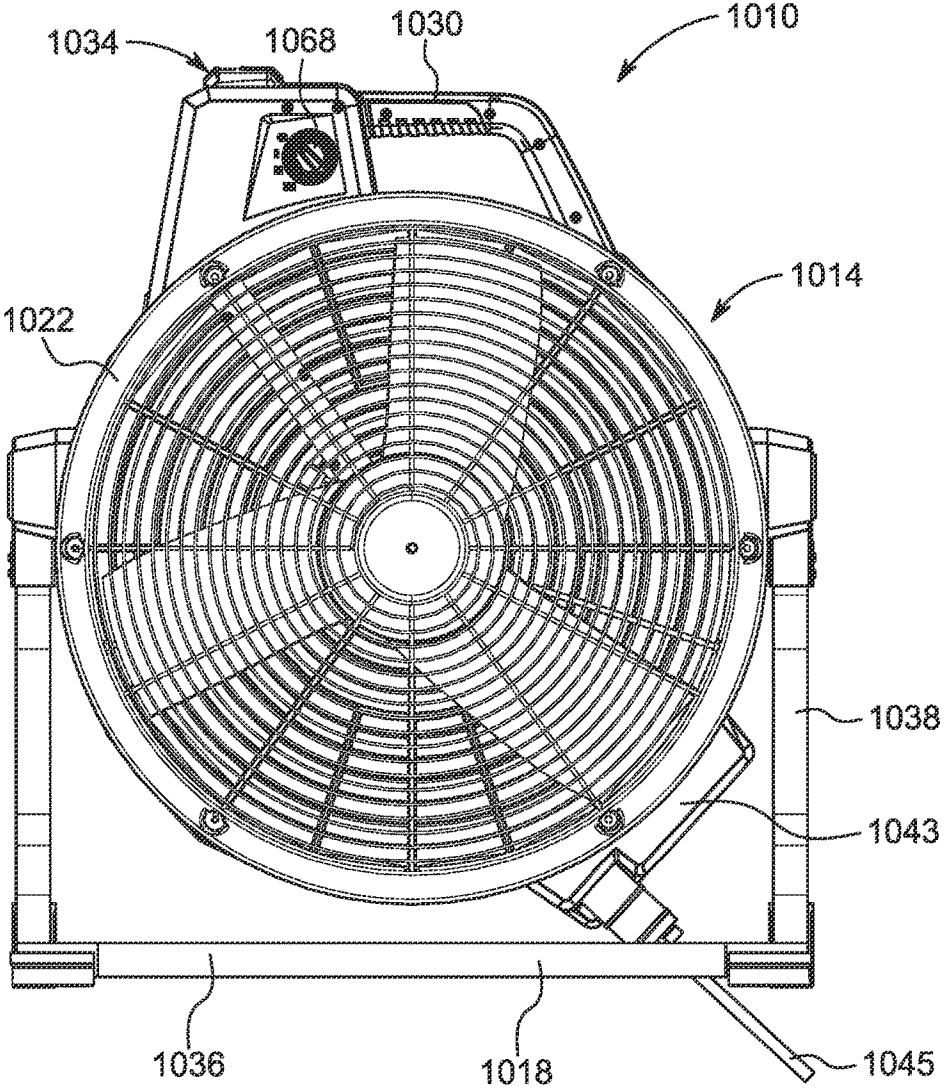
FIG. 32 is a rear perspective view of the fan assembly FIG. 29.
Figure 33:
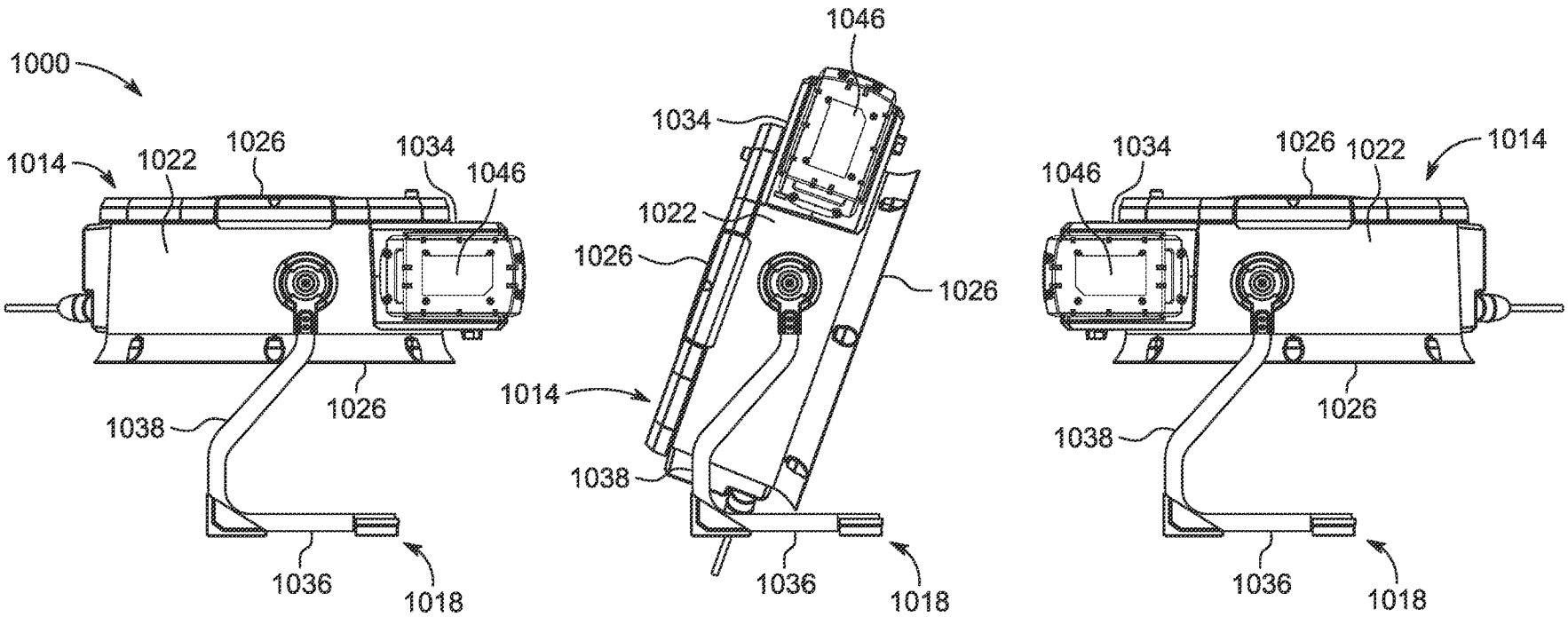
FIG. 33 is a side view of the fan assembly FIG. 29, showing the housing in three possible orientations with respect to the base.

A charging status of the battery pack 1046 may be provided by an indicator 1048, such as a visual indicator, and audio indicator, etc. In the illustrated embodiment, the indicator 1048 includes a meter, gauge, or at least one illuminator, such as an LED, bulb, and/or the like. As illustrated in FIG. 31, the indicator 1048 is positioned on the handle 1030. In other embodiments, the indicator 1048 is positioned elsewhere on the fan assembly 1010 (e.g., housing 1014, shroud 1022, base 1018, etc.). In some embodiments, multiple indicators are provided, such as a visual indicator and an audio indicator.

FIG. 34 illustrates one example construction of the housing 1014 in which the motor 1040 is supported by the grille 1026 at one end with a rotating spindle 1050 of the motor 1040 extending rearwardly into the blades 1042. In the example construction shown in FIG. 34, wiring between the motor 1040 and the battery pack 1046 may be routed through a portion of the shroud 1022 and a portion of the grille 1026 to deliver power to the motor 1040. Stated another way, FIG. 34 illustrates one example construction of the housing 1014 in which the motor 1040 is supported forwardly of the blades 1042.

FIG. 35 illustrates another example construction of the housing 1014 in which the motor 1040 is supported by the shroud 1022 at one end with the rotating spindle 1050 of the motor 1040 extending forwardly into the blades 1042. In the example construction shown in FIG. 35, wiring between the motor 1040 and the battery pack 1046 may be routed through a portion of the shroud 1022 to deliver power to the motor 1040. Stated another way, FIG. 35 illustrates one example construction of the housing 1014 in which the motor 1040 is supported rearwardly of the blades 1042. In some embodiments, wiring electrically communicating the battery receptacle 1034 and the motor 1040 is routed through at least one of the vanes 1037. In the illustrated embodiment, a rotational axis of the blades 1042 and a rotational axis of the rotating spindle 1050 are centrally aligned relative to one another within the airflow chamber.

Regardless of construction, the motor 1040 may be operated at multiple speeds in order to provide multiple modes of operation of the fan assembly 1010 (e.g., high, medium, low, etc.). The different modes may be selected by a user operating a selector 1068 (FIG. 32), such a rotatable knob, a sliding or pivoting switch, a push button, and/or the like. In the illustrated embodiment, the selector 1068 is rotatable to an off position indicated by an "0" indicia, a first speed position indicated by an "I" indicia, a second speed positioned indicated by a "II" indicia, and a third speed positioned indicated by a "III" indicia. Each position generally corresponds to a speed of the motor 1040. In other embodiments, the rotational speed of the motor 1040 may be infinitely selectable between a first (low or off speed) and a second (high or max speed).

The selector 1068 may be coupled to a portion of the housing 1014, and the indicia may be displayed on the housing 1014 adjacent the selector 1068. In the illustrated embodiment, the selector 1068 is positioned on a part of the battery receptacle 1034, adjacent a printed circuited board assembly "PCBA" positioned with in a PCBA housing 1072. The PCBA may include a controller intermediate the selector 1068 and the motor 1040 to electrically communicate electrical components, such as the motor 1040, the selector 1068, the battery receptacle 1034, the AC box 1043, indicators 1048, and/or the like. In some embodiments, the AC box 1043 houses one or more additional PCBA(s), controllers, convertors, terminals, and/or the like.

Wiring between the AC box 1043, the motor 1040, the PCBA(s), and the battery pack 1046 may be routed through the housing 1014, such as a portion of the shroud 1022 and/or a portion of the grille 1026. In some embodiments, the AC box 1043 is supported by the battery receptacle 1034. In other embodiments, the AC box 1043 is integrally formed with the battery receptacle 1034 and PCBA housing 1072. In such embodiments, wiring for the AC box 1043, the battery receptacle 1034, the PCBA(s), the indicator 1048, the selector 1068, etc. does not need to be routed through the housing 1014.

The embodiment(s) described above and illustrated in the figures are presented by way of example only and are not intended as a limitation upon the concepts and principles of the present disclosure. As such, it will be appreciated that variations and modifications to the elements and their configuration and/or arrangement exist within the spirit and scope of one or more independent aspects as described. For example, the various housings (e.g., housing 14, 114, 214 . . . etc.) and bases (e.g., base 18, 118, 218 . . . etc.), as well as additional features thereof, could be interchangeably incorporated across multiple embodiments, discussed or otherwise.

What is claimed is:

1. A fan assembly comprising:

a fan housing including a shroud that at least partially defines an airflow chamber, the shroud including an outer wall, vanes extending inwardly from the outer wall, and a mount coupled to the vanes;

a battery receptacle positioned on the shroud, the battery receptacle configured to receive a removable battery pack to provide power to the fan assembly;

a first grille coupled to a first side of the shroud, the first grille positioned adjacent an end of the airflow chamber;

a fan supported within the airflow chamber;

a motor supported by the mount, the motor operable to drive rotation of the fan and thereby generate airflow through the airflow chamber; and a base rotatably coupled to the fan housing about an axis, the base operable to support the fan housing in multiple configurations to direct the airflow in multiple directions; and an AC power unit supported by the fan housing and configured to power to the motor;

wherein the AC power unit and the battery receptacle are disposed on opposite sides of the axis.

2. The fan assembly of claim 1, wherein a second grille is coupled to a second side of the shroud that is opposite the first side, and wherein the fan and the motor are fully positioned between the opposite ends of the airflow chamber.

3. The fan assembly of claim 1, wherein wiring electrically communicating the battery receptacle to the motor is routed through at least one of the vanes.

4. The fan assembly of claim 1, wherein the AC power unit includes terminals configured to receive a power cable.

5. The fan assembly of claim 1, wherein the battery receptacle and the AC power unit are both supported on a circumferential wall of the shroud.

6. The fan assembly of claim 1, wherein the AC power unit is coupled to the battery receptacle such that the removable battery pack is configured to receive charging power communicated from the AC power unit to the battery receptacle.

7. The fan assembly of claim 6, wherein the AC power unit and the battery receptacle are supported on diametrically opposing sides of the fan housing.

8. The fan assembly of claim 6, wherein the AC power unit is configured to simultaneously power the motor and charge the removable battery pack.

9. A fan assembly comprising:

a fan housing including a shroud that at least partially defines an airflow chamber;

a battery receptacle supported on the shroud, the battery receptacle configured to receive a removable battery pack to provide power to the fan assembly;

a handle extending from the battery receptacle to the shroud;

a selector disposed on the battery receptacle configured to operatively control the fan;

a first grille positioned adjacent a first end of the airflow chamber;

a motor supported by the shroud, the motor operable to drive rotation of the fan and thereby generate airflow through the airflow chamber;

a fan supported within the airflow chamber and rotatably coupled to the motor;

a base coupled to the fan housing, the base operable to support the fan housing in multiple configurations to direct the airflow in multiple directions.

* * * * *